US007998918B2

(12) United States Patent
Rong et al.

(10) Patent No.: US 7,998,918 B2
(45) Date of Patent: Aug. 16, 2011

(54) CLEANING COMPOSITIONS FOR HARD SURFACES COMPRISING A SILYL POLYALKOXYLATE

(75) Inventors: Haitao Rong, Darmstadt (DE); Matthias Schweinsberg, Hamburg (DE); Heinz-Dieter Soldanski, Essen (DE); Marina Glesius, Darmstadt (DE)

(73) Assignee: Henkel AG & Co. KGaA (DE)

( * ) Notice: Subject to any disclaimer, the term of this patent is extended or adjusted under 35 U.S.C. 154(b) by 109 days.

(21) Appl. No.: 12/517,201

(22) PCT Filed: Dec. 4, 2007

(86) PCT No.: PCT/EP2007/063203

§ 371 (c)(1),
(2), (4) Date: Jun. 2, 2009

(87) PCT Pub. No.: WO2008/068235

PCT Pub. Date: Jun. 12, 2008

(65) Prior Publication Data

US 2010/0081596 A1 Apr. 1, 2010

(30) Foreign Application Priority Data

Dec. 5, 2006 (DE) ..... 10 2006 057 632
Aug. 22, 2007 (DE) ..... 10 2007 039 649

(51) Int. Cl.
*C11D 9/36* (2006.01)
*C11D 1/29* (2006.01)

(52) U.S. Cl. ..... 510/466; 510/221; 510/228; 510/235; 510/238; 510/245; 510/364; 510/365; 510/425; 510/426; 510/427; 510/428

(58) Field of Classification Search ..... 510/221, 510/228, 235, 238, 245, 364, 365, 425, 426, 510/427, 428, 466
See application file for complete search history.

(56) References Cited

U.S. PATENT DOCUMENTS 4,749,515 A * 6/1988 Miyamoto et al. ..... 510/414
5,475,127 A 12/1995 Klein et al.
6,004,545 A * 12/1999 Karlen et al. ..... 424/70.12
6,090,765 A * 7/2000 Black et al. ..... 510/238
6,150,311 A * 11/2000 Decoster et al. ..... 510/122
6,255,434 B1 7/2001 McGraw et al.
6,423,661 B1 7/2002 McGraw et al.
6,528,070 B1 * 3/2003 Bratescu et al. ..... 424/401
7,186,675 B2 3/2007 Meine et al.
2002/0064510 A1 * 5/2002 Dalrymple et al. ..... 424/70.22
2002/0193270 A1 * 12/2002 Cermenati et al. ..... 510/302
2003/0153712 A1 8/2003 Ludewig et al.
2004/0033924 A1 * 2/2004 Murphy et al. ..... 510/421
2004/0096507 A1 5/2004 Kwang et al.
2005/0233925 A1 * 10/2005 Foley et al. ..... 510/197
2006/0104937 A1 * 5/2006 Bailey et al. ..... 424/70.22
2007/0128143 A1 * 6/2007 Gruning et al. ..... 424/70.12

FOREIGN PATENT DOCUMENTS

EP 0679653 A 11/1995
WO WO-96/18717 A1 6/1996
WO WO-97/00609 A1 1/1997
WO WO-02/22770 A1 3/2002

* cited by examiner

*Primary Examiner* — Charles I Boyer
(74) *Attorney, Agent, or Firm* — Connolly Bove Lodge & Hutz LLP

(57) ABSTRACT

Aqueous liquid compositions containing: (a) at least one alkyl ether sulphate (b) at least one multi-armed silyl polyalkoxylate of the formula (I) $(H\text{-}A)_n\text{-}Z\text{-}[A\text{-}B\text{—}Si(OR^1)_r(R^2)_{3-r}]_m$ (I), where Z is an (m+n)-valent radical having at least three carbon atoms, A is a divalent polyoxyalkylene radical, wherein the m+n polyoxyalkylene radicals bound to Z can be different from one another, and wherein one radical A is in each case bound to Z via an oxygen atom belonging to Z, and one oxygen atom belonging to A is bound to B or hydrogen, B is a chemical bond or a divalent organic radical having 1 to 50 carbon atoms, $OR^1$ is a hydrolysable group, $R^1$ and $R^2$ independently of one another are a linear or branched alkyl group having 1 to 6 carbon atoms and r is an integer from 1 to 3, and m is an integer ≧1 and n is 0 or an integer ≧1, and m+n has a value from 3 to 100, and (c) 0-50% of at least one alkylsulphonate and/or arylsulphonate; (d) 0-15% of at least one alkyl sulphate and/or (e) 0-20% of at least one amphoteric surfactant cause an improvement of the drying and draining behavior in the cleaning of hard surfaces, in particular dishes.

20 Claims, No Drawings

CLEANING COMPOSITIONS FOR HARD SURFACES COMPRISING A SILYL POLYALKOXYLATE

RELATED APPLICATIONS

This application is a national stage application under 35 U.S.C. §371 of PCT/EP2007/063203, filed Dec. 4, 2007, which claims benefit of German application 102006057632.2, filed Dec. 5, 2006 and German application 102007039649.1, filed Aug. 22, 2007.

The present invention lies in the field of cleaning agents for cleaning hard surfaces, in particular dishes.

After manual moist or wet cleaning of hard surfaces in the home and in industry with a water-based surfactant-containing solution, the moist or wet hard surfaces are either simply left to dry or are dried in an additional step, normally with an absorbent cloth. Leaving the surfaces to dry is less labor-intensive, but takes longer and, in the case of shiny (with a mirror finish, reflective) hard surfaces, for example of glass, china, ceramic, plastic or metal, regularly leads to the formation of unwanted visible residues, such as stains (water stains) or streaks, and to a loss of shine or a dull appearance. This applies in particular to the manual cleaning of tableware, more particularly glasses and other items of glass tableware, when the tableware is first cleaned in a wash liquor—an aqueous solution of a surfactant-containing agent, normally at an elevated temperature of, for example, about 45° C.—and is then left to dry in air, i.e. is not dried off with an absorbent cloth. When a cleaned glass or plate is removed from the wash liquor, the wash liquor is first poured out or off and the glass or plate is left to dry. The layer of wash liquor remaining on the surface of the glass or plate drains off slowly until, finally, it becomes so thin that it no longer drains off, but only diminishes by (self) drying. Drying also takes place during drainage.

International patent application WO 96/18717 A1 (Colgate-Palmolive Company) discloses a skin-friendly liquid water-based cleaning agent for hard surfaces in the form of a clear micro emulsion which effectively removes fatty and bath soils, leaves a sparkling appearance behind on unrinsed surfaces and contains 14 to 24% by weight of an alkali metal salt of a C12-18 paraffin sulfonate, 2 to 6% by weight of an alkali metal salt of an ethoxylated C12-18 alkyl ether sulfate and 2 to 8% by weight of a betaine surfactant and a non-ionic surfactant, at least one solubilizer, a co-surfactant and a water-insoluble hydrocarbon, a perfume or an essential oil. A disadvantage of such agents is their unfavorable drying behavior.

Accordingly, there was a need to provide quick-drying, surfactant-containing cleaning agents for cleaning hard surfaces which would show improved drying and sparkling properties.

U.S. Pat. No. 6,423,661 B1 describes silyl-terminated prepolymers that are manufactured by reacting an isocyanate-silane with the OH groups of a polyether polyol that can possess up to eight arms. The resulting prepolymers of the cited compounds find use in adhesives. A use of the prepolymers in cleaning agents was not disclosed.

A polyurethane prepolymer having terminal alkoxy silane groups and hydroxyl groups is known from US 2003/0153712 A1. For their manufacture, a polyether diol is initially treated with a stoichiometric deficiency of diisocyanate, and the silyl groups are then introduced by further treating the resulting isocyanate-hydroxy compound with an aminosilane. The described two-armed polyalkoxylates in the form of prepolymers are used in the manufacture of sealants and adhesives.

US 2004/0096507 A1 deals with six-armed polyethylene glycol derivatives and discloses a fully silyl terminated derivative that can be manufactured from sorbitol as the central moiety. The polyethylene glycol derivatives described in the document are intended to be suitable for manufacturing biologically degradable polymeric hydrogels and for use in the medical/pharmaceutical field for implants.

The object of the present invention is to improve the drying or drainage behavior of aqueous surfactant-containing solutions for cleaning hard surfaces, in particular to accelerate the drying or the drainage.

The present object is achieved according to the invention by an aqueous liquid material comprising:

(a) at least one alkyl ether sulfate (b) at least one multi-arm silyl polyalkoxylate of Formula (I)

$$(H\text{-}A)_n\text{-}Z\text{-}[A\text{-}B\text{—}Si(OR^1)_r(R^2)_{3-r}]_m \quad (I),$$

in which

Z stands for an (m+n) valent group having at least three carbon atoms, A means a divalent polyoxyalkylene group, wherein the (m+n) polyoxyalkylene groups that are bonded to Z can be different from one another, and wherein one A group is bonded with Z through an oxygen atom that belongs to Z and one oxygen atom that belongs to A is bonded with B or hydrogen, B stands for a chemical bond or for a divalent organic group having 1 to 50 carbon atoms, $OR^1$ means a hydrolysable group, $R^1$ and $R^2$ independently of one another mean a linear or branched alkyl group having 1 to 6 carbon atoms and r stands for a whole number from 1 to 3 and m is a whole number >1 and n stands for 0 or a whole number >1, and m+n has a value of 3 to 100, and (c) 0-50% of at least one alkyl- and/or aryl sulfonate;

(d) 0-15% of at least one alkyl sulfate and/or (e) 0-20% of at least one amphoteric surfactant.

It was surprisingly found that the addition of silyl polyalkoxylates of the Formula (I) to conventional cleaning agent formulations contributed to a considerable improvement in the drying and draining properties for a constant washing power.

The inventive agent is suitable as a cleaning agent for hard surfaces (abb. cleaning agent) and particularly as a manual dishwashing agent (abb. dishwashing agent). The at least one silyl polyalkoxylated of Formula (I) improves the drying and draining properties, i.e. it increases in particular the drying rate and reduces the formation of residues.

The present invention further relates to the use of the inventive agent for cleaning hard surfaces, in particular dishes. The inventive agent is preferably used for the manual cleaning of hard surfaces, in particular for the manual cleaning of dishes. Besides tableware, hard surfaces also refer to all usual hard surfaces, in particular of glass, ceramic, plastic or metal, in the household and in industry. The main advantage of the inventive agent or the inventive use is the significantly improved drying and draining properties provided by the at least one silyl polyalkoxylated of Formula (I), in particular the high drying rate and short drying time, the high draining rate and short draining time as well as the low formation of residue and the retained sparkle. Drying in this context is understood to mean both the overall drying, in particular until moisture is neither visually nor haptically perceptible on the surface, as well as in particular the drying following the draining. Another subject matter of the present invention is consequently the use of the inventive agent to improve the drying and/or draining properties.

A further advantage of the inventive agent or the inventive use is the high cleaning performance (synonyms: cleaning power or cleaning capacity or rinsing performance, rinsing power or rinsing capacity), especially on fat-containing stains.

Still another advantage of the inventive agent is its high storage stability.

In the context of the present invention, multi-armed silyl polyalkoxylates comprise polymer arms that are essentially star-shaped or radially linked to a central moiety.

In a preferred embodiment of the invention, a silyl polyalkoxylated of Formula (I) or a mixture of a plurality of these compounds is employed, wherein the mass average (weight average of the molecular weight) is 500 to 50 000, preferably 1000 to 20 000, and particularly preferably 2000 to 10 000. In this case the silyl polyalkoxylate preferably comprises 0.3 to 10 wt. %, particularly preferably 0.5 to 5 wt. % silicon, based on the total weight of the silyl polyalkoxylate.

Z preferably stands for an at least trivalent, especially tri- to octavalent, acyclic or cyclic hydrocarbon group containing 3 to 12 carbon atoms, wherein the group can be saturated or unsaturated and in particular also aromatic. Particularly preferably, Z stands for the trivalent residue of glycerol or the tri- to octavalent residue of a sugar, for example the hexavalent residue of sorbitol or the octavalent residue of sucrose. The x-valent residue of one of the abovementioned polyols is understood to mean that molecule fragment that remains after removing the hydrogen atoms from the x alcoholic or phenolic hydroxyl groups. Fundamentally, Z can stand for any central moiety that is known from the literature for manufacturing star-shaped (pre)polymers.

In addition, it is particularly preferred if in Formula (I) n stands for 0, 1 or 2 and m means a number from 3 to 8.

A preferably stands for groups selected from poly $C_2$-$C_4$ alkylene oxides, particularly preferably for a (co)polymer of ethylene oxide and/or propylene oxide, particularly for a copolymer having a propylene oxide content of up to 60 wt. %, preferably up to 30 wt. % and particularly preferably up to 20 wt. %, wherein the copolymer can be a random or block copolymer. Accordingly, in a further preferred embodiment of the invention, A in Formula (I) stands for $—(CHR^3—CHR^4—O)_p—$, wherein $R^3$ and $R^4$ independently of one another stand for hydrogen, methyl or ethyl and p means a whole number from 2 to 10 000.

B stands in particular for a chemical bond or for a divalent, low molecular weight organic group having preferably 1 to 50, especially 2 to 20 carbon atoms. Exemplary divalent, low molecular weight organic groups are short chain aliphatic and heteroaliphatic groups such as for example $—(CH_2)_2—$, $—(CH_2)_3—$, $—C(O)—NH—(CH_2)_3—$ and $—C(O)—NH—X—NH—C(O)—NH—(CH_2)_3—$, wherein X stands for a divalent aromatic group such as the phenylene group or for an alkylidene group. B stands quite particularly preferably for a bond or for the group $—C(O)—NH—(CH_2)_3—$.

$R^1$ and $R^2$ independently of one another preferably stand for methyl or ethyl, and r for 2 or 3. Examples of groups $—Si(OR^1)_r(R^2)_{3-r}$ are dimethylethoxysilyl-, dimethylmethoxysilyl-, diisopropylethoxysilyl-, methyldimethoxysilyl-, methyldiethoxysilyl-, trimethoxysilyl-, triethoxysilyl- or tri-t-butoxysilyl-groups, but quite particularly preferably trimethoxysilyl- and triethoxysilyl-groups.

Quite preferably, $R^1$ and $R^2$ are identical and stand for methyl or ethyl.

Moreover, it is particularly preferred when r stands for the number 3.

The sum of m+n is preferably 3 to 50, especially 3 to 10 and particularly preferably 3 to 8, and is consistent with the number of arms that are bonded to the central moiety Z in the compound (I). Therefore, the central moiety possesses preferably 3 to 50, especially 3 to 10 and particularly preferably 3 to 8 oxygen atoms that are the link points for the arms.

In a particular embodiment, n=0. For the case n>0, the ratio n/m is between 99/1 and 1/99, preferably 49/1 and 1/49, and especially 9/1 and 1/9.

In another preferred embodiment of the invention, a mixture of at least two, especially two to four different multi-arm silyl polyalkoxylates of Formula (I) is employed.

In this case it is particularly preferred when the at least two different multi-arm silyl polyalkoxylates differ in the number of their arms. Here, a first silyl polyalkoxylate with 3 to 6 arms is advantageously combined with a second silyl polyalkoxylate with 6 to 10 arms.

Particularly preferred mixtures comprise at least two different silyl polyalkoxylates of Formula (I) with n=0, which are selected from the group of the multi-arm silyl polyalkoxylates of Formula (I) with m=3, m=6 and m=8.

If two different multi-arm silyl polyalkoxylates are employed, then in general they are present in the ratio 99:1 to 1:99, preferably 49:1 to 1:49, and especially 9:1 to 1:9.

In another particularly preferred embodiment of the invention, the inventive agent additionally comprises a hydrolysable silicic acid derivative.

Hydrolysable silicic acid derivatives are understood in particular to mean esters or ortho silicic acid, especially the tetraalkoxysilanes and quite particularly preferably tetraethoxysilane.

In this embodiment, it is particularly advantageous if the ratio of silyl polyalkoxylate or silyl polyalkoxylate mixture to the at least one hydrolysable silicic acid derivative is 90:10 to 10:90, preferably 50:50 to 10:90 and especially 40:60 to 20:80.

The at least one silyl polyalkoxylate of Formula (I) is usually added in quantities of 0.01 to 10 wt. %, preferably 0.05 to 5 wt. % and particularly preferably 0.1 to 2.5 wt. %, based on the total weight of the agent.

Should the inventively used multi-arm silyl polyalkoxylates of the general Formula (I) not be known from the literature, then they can be manufactured by functionalizing suitable multi-arm polyalkoxylate intermediates in analogy to the functionalization processes known from the prior art.

The two-arm polyurethane prepolymer with terminal alkoxysilane and hydroxyl groups which is described in US 2003/0153712 A1 is manufactured by initially treating a polyether dial with a stoichiometric deficiency of diisocyanate, and the silyl groups are then introduced by further treating the resulting isocyanate-hydroxy compound with an aminosilane. The synthetic principles applied in this US document can be basically transposed to manufacture multi-arm polyalkoxylates according to the teaching of the present invention.

U.S. Pat. No. 6,423,661 B1 describes silyl-terminated prepolymers that are manufactured by reacting an isocyanate-silane with the OH groups of a polyether polyol that can possess up to eight arms. The teaching of this document includes prepolymers that fall under the general Formula (I) of the present invention.

US 2004/0096507 A1 deals with six-arm polyethylene glycol derivatives and discloses a fully silyl terminated derivative that can be manufactured from sorbitol as the central moiety and falls under the general Formula (I) of the present invention.

Suitable polyalkoxylate intermediates for manufacturing the inventively used silyl polyalkoxylates are themselves also multi-arm polyalkoxylates that already possess the above-described multi-arm structure and which have a hydroxyl group on each end of the polymer arms which can be partially or totally converted into the group(s) —B—$Si(OR^1)_r(R^2)_{3-r}$. The polyalkoxylate precursors of the inventively added silyl polyalkoxylates can be represented by the general Formula (II)

$$Z\text{-}(A\text{-}OH)_{m+n} \quad (II)$$

wherein Z, A, m and n have the same meaning as previously described for the compounds of the Formula (I).

Exemplary suitable polyalkoxylate precursors are known from the literature with the designation star-shaped or multi-arm polyether polyols. These polyalkoxylate precursors are manufactured by polymerizing suitable monomers, in particular ethylene oxide and/or propylene oxide, with multi-functional small molecules such as for example glycerine or sorbitol as the initiator. As examples of multi-arm polyether polyols, one may cite ethoxylates or propoxylates of glycerine, sucrose and sorbitol, as are described in the U.S. Pat. No. 6,423,661. Due to the statistical nature of the polymerization reaction, the above-cited designations concerning the polymer arms of the inventively used silyl polyalkoxylates, particularly in regard to the arm lengths and number of arms (m+n), are each a statistical average.

Some of the suitable polyalkoxylate precursors are also commercially available. An example is Voranol 4053, a polyether polyol (poly(ethylene oxide-co-propylene oxide)) from DOW Chemicals. It is a mixture of two different polyether polyols, consisting of a 3-arm polyether polyol with glycerine as the central moiety together with an 8-arm polyether polyol having raw sugar as the central moiety. The arms are represented by copolymers of ca. 75% EO and ca. 25% PO, the OH functionality (hydroxyl end groups) is on average 6.9 for a mass average (weight average of the molecular weight) of ca. 12 000. The outcome of this is a ratio of about 78% of 8-arm polyether polyol and about 22% of 3-arm polyether polyol. Another example is Wanol R420 from the WANHUA company, China, which is a mixture of a linear poly(propylene/ethylene)-diethylene glycol and a 8-arm polyether polyol (poly(propyleneoxy/ethyleneoxy)sucrose) in a ratio of ca. 15-25: 85-75. Likewise, the polyether polyol Voranol CP 1421 from DOW Chemicals is commercially available and is a 3-arm statistical poly(ethylene oxide-co-propylene oxide) with an EO/PO ratio of ca. 75/25 and a mass average (weight average of the molecular weight) of ca. 5000.

As starting materials for the conversion of the hydroxyl end groups of the multi-arm polyalkoxylate intermediate into —B—$Si(OR^1)_r(R^2)_{3-r}$ groups, one may consider all functional silanes that possess a functional group that is reactive towards the hydroxyl end groups of the polyalkoxylate intermediate. Examples are tetraalkoxysilanes such as tetramethylsilicate and tetraethylsilicate, (meth)acrylate-silanes such as (3-methacryloxypropyl)trimethoxysilane, (methacryloxymethyl)triethoxysilane, (methacryloxymethyl)methyldimethoxysilane and (3-acryloxypropyl)trimethoxysilane, isocyanato-silanes such as (3-isocyanatopropyl)trimethoxysilane, (3-isocyanatopropyl)triethoxysilane, (isocyanatomethyl)methyldimethoxysilane and (isocyanatomethyl)trimethoxysilane, aldehyde-silanes such as triethoxysilylundecanal and triethoxysilylbutyraldehyde, epoxy-silanes such as (3-glycidoxypropyl)trimethoxysilane, anhydride-silanes such as 3-(triethoxysilyl)propylsuccinic anhydride, halogen-silanes such as chloromethyltrimethoxysilane and 3-chloropropylmethyldimethoxysilane, hydroxy-silanes such as hydroxymethyltriethoxysilane, as well as tetraethylsilicate (TEOS), which are commercially available from e.g. Wacker Chemie GmbH (Burghausen), Gelest, Inc. (Morrisville, USA) or ABCR GmbH & Co. KG (Karlsruhe) or can be manufactured by known processes. Tetraalkoxy-silanes, isocyanato-silanes or anhydride-silanes, but especially tetraalkoxy-silanes, treated with multi-arm polyalkoxylate intermediates of the general Formula (II) are particularly preferred. The exhaustive conversion of all hydroxy ends with the functional silanes yields inventively used multi-arm silyl polyalkoxylates that exclusively bear —B—$Si(OR^1)_r(R^2)_{3-r}$ groups on the ends of the arms, i.e. wherein n=0. In such a case the B group consists exclusively of a bond, or it includes, when an isocyanatosilane was used as the functional silane, together with the terminal oxygen atom of the A group, for example a urethane group together with the atom group that is located between the isocyanato group and the silyl group in the starting isocyanatosilane. The exhaustive conversion of all hydroxy ends with anhydride-silanes, for example 3-(triethoxysilyl)propylsuccinic anhydride, yields multi-arm silyl polyalkoxylates that exclusively bear —B—$Si(OR^1)_r(R^2)_{3-r}$ groups. In such a case the B group includes, together with the terminal oxygen atom of the A group, an ester group together with the atom group that is located between the anhydride group and the silyl group in the starting anhydride-silane.

If inventively used multi-arm silyl polyalkoxylates of the general Formula (I) are manufactured which bear hydroxyl groups as well as —B—$Si(OR^1)_r(R^2)_{3-r}$ groups on the ends of their arms, then the procedure would preferably be as follows: a polyalkoxylate intermediate of the general Formula (II) is reacted with a sub-stoichiometric quantity (based on the total number of hydroxy end groups) of a functional silane, i.e. as described above by initially introducing —B—$Si(OR^1)_r(R^2)_{3-r}$ groups, but without reacting all the hydroxy end groups in the multi-arm polyalkoxylate intermediate. This procedure affords multi-arm polyalkoxylates that bear both hydroxyl groups as well as —$Si(OR^1)_r(R^2)_{3-r}$ groups. Thus, for example, a partial conversion of the hydroxyl ends of a multi-arm polyether polyol with isocyanato-silanes affords multi-arm polyalkoxylates that bear terminal silyl groups as well as OH groups. In an additional step, the remaining or a part of the remaining hydroxyl groups can be modified—as described—to —B—$Si(OR^1)_r(R^2)_{3-r}$ groups.

Besides the at least one silyl polyalkoxylate, the type and quantity of additional components comprised in the inventive aqueous agent are to be selected such that unwanted interactions with the silyl polyalkoxylate do not occur.

In the context of the present invention, fatty acids or fatty alcohols or their derivatives—when not otherwise specified—represent branched or unbranched carboxylic acids or alcohols or their derivatives containing preferably 5 to 26 carbon atoms. Esters, due to their vegetal basis as well as being based on renewable raw materials, are particularly preferred on ecological grounds, without however the inventive teaching being limited to them. In particular, the oxo-alcohols or their derivatives, which are obtained, for example from Röelen's oxo synthesis, can also be appropriately employed. Suitable alcohols are also Lial® types as well as the less branched Neodol® types (Shell-Corp.). If the alkyl esters of fatty acid groups or tallow groups are mentioned, they are understood to mean the alkyl groups that derive from the respective hydrogenated acids.

In the following, whenever alkaline earth metals are named as counter ions for monovalent anions, then that means, of course, that the alkaline earth metal is present only in half the amount of the anion i.e. sufficient to equalize the charge.

Substances that also serve as ingredients of cosmetics are hereafter, where appropriate, named in accordance with the International Nomenclature Cosmetic Ingredient (INCI) Nomenclature. Chemical compounds carry an INCI name in English, vegetal ingredients are listed exclusively according to Linne in Latin. Trivial names such as "water", "honey" or "sea salt" are also given in Latin. The INCL names are to be found in the International Cosmetic Ingredient Dictionary and Handbook, 7th Edition (1997), published by The Cosmetic, Toiletry and Fragrance Association (CTFA), 1101, 17$^{th}$ Street NW, Suite 300, Washington, D.C. 20036, U.S.A., and comprises more than 9000 INCI names as well as more than 37 000 trade names and technical names including the associated distributors from more than 31 countries. The International Cosmetic Ingredient Dictionary and Handbook classifies the ingredients into one or more chemical classes, for example "Polymeric Ethers", and into one or more functions, for example "Surfactants—Cleansing agents", which are again mentioned in more detail. Reference to these will also be made below, as appropriate.

The indication CAS means that the following series of numbers relates to a name from the Chemical Abstracts Service.

Unless otherwise explicitly stated, the stated amounts refer to weight percent (wt. %) of the total agent.

Surfactants

The inventive agent comprises surfactants in quantities of typically 0.5 to 60 wt. %, advantageously 1 to 55 wt. %, particularly 5 to 50 wt. %, particularly preferably 10 to 45 wt. % and most preferably 15 to 40 wt. %. Fractions for example of 18, 25, 32 and/or 36 wt. % are particularly preferred.

In addition to alkyl ether sulfates and optionally alkyl and/or aryl sulfonates, alkyl sulfates and/or amphoteric surfactants, the inventive agent can comprise one or more additional anionic surfactants, non-ionic surfactants and/or cationic surfactants, in particular for improving the cleaning power, draining properties and/or drying properties.

The alkyl ether sulfates, alkyl and/or alkyl sulfonates and/or alkyl sulfates and the other anionic surfactants are normally used in the form of alkali metal, alkaline earth metal and/or mono-, di- or trialkanolammonium salts and/or in the form of the corresponding acids to be neutralized in situ with the corresponding alkali metal hydroxide, alkaline earth metal hydroxide and/or mono-, di or trialkanolamine. Preferred alkali metals are potassium and in particular sodium, preferred alkaline earth metals are calcium and in particular magnesium and preferred alkanolamines are mono-, di- or triethanolamine. The sodium salts are particularly preferred.

Alkyl Ether Sulfates

Alkyl ether sulfates (fatty alcohol ether sulfates, INCI Alkyl Ether Sulfates) are products of sulfation reactions on alkoxylated alcohols. Alkoxylated alcohols are generally understood by the person skilled in the art to be the reaction products of alkylene oxide, preferably ethylene oxide, with alcohols—in the context of the invention preferably with relatively long-chain alcohols, i.e. with aliphatic straight-chain or single- or multiple-branch, acyclic or cyclic, saturated or mono- or polyunsaturated, preferably straight-chain, acyclic saturated alcohols containing 6 to 22, preferably 8 to 18, more preferably 10 to 16 and most preferably 12 to 14 carbon atoms. Depending on the reaction conditions, a complex mixture of addition products with different degrees of ethoxylation is generally formed from n moles ethylene oxide and one mole alcohol (n=1 to 30, preferably 0.3 to 20, more preferably 0.3 to 10 and most preferably 0.3 to 5). Another embodiment of the alkoxylation consists in the use of mixtures of the alkylene oxides, preferably a mixture of ethylene oxide and propylene oxide. Fatty alcohols with low degrees of ethoxylation, i.e. with 0.3 to 4 ethylene oxide units (EO), more particularly 0.3 to 20 EO, for example 0.5 EO, 1.0 EO, 1.3 EO and/or 2.0 EO, such as Na $C_{12-14}$ fatty alcohol+0.5 EO sulfate, Na $C_{12-14}$ fatty alcohol+1.3 EO sulfate, Na $C_{12-14}$ fatty alcohol+2.0 EO sulfate and/or Mg $C_{11-14}$ fatty alcohol+1.0 EO sulfate, are most particularly preferred in the context of the present invention.

The inventive agent comprises one or more alkyl ether sulfates, usually in an amount of 1 to 50 wt. %, preferably 3 to 40 wt. %, particularly more than 6 to 30 wt. %, particularly preferably 8 to 20 wt. %, above all 10 to 16 wt. %.

Alkyl and/or Aryl Sulfonates

The alkyl sulfonates (INCI Sulfonic Acids) normally contain an aliphatic, straight-chain or single- or multiple-branch, acyclic or cyclic, saturated or mono- or polyunsaturated, preferably branched, acyclic, saturated alkyl group containing 6 to 22, preferably 9 to 20, more preferably 11 to 18 and most preferably 13 to 17 carbon atoms.

Accordingly, suitable alkyl sulfonates are the saturated alkane sulfonates, the unsaturated olefin sulfonates and the ether sulfonates (formally derived from the alkoxylated alcohols on which the alkyl ether sulfates are also based) which are divided into terminal ester sulfonates (n-ether sulfonates) with the sulfonate function attached to the polyether chain and internal ester sulfonates (i-ester sulfonates) with the sulfonate function attached to the alkyl group.

According to the invention, the alkane sulfonates, more particularly alkane sulfonates with a branched, preferably secondary, alkyl group, for example the secondary alkane sulfonate sec. Na $C_{13-17}$ alkane sulfonate (INCI Sodium C14-17 Alkyl Sec Sulfonate), are preferred.

Preferred aryl sulfonates are alkyl benzenesulfonates, the alkyl groups being branched and unbranched chains with 1 to 20, preferably 2 to 18, more preferably 6 to 16 and most preferably 8 to 12 carbon atoms. Particularly preferred examples are linear alkyl benzenesulfonates (LAS) and/or cumenesulfonate.

In a preferred embodiment, the agent according to the invention comprises one or more alkyl and/or aryl sulfonates in a quantity of typically 0.1 to less than 50% by weight, preferably 0.1 to 30% by weight, more preferably 1 to less than 14% by weight, most preferably 2 to 10% by weight and most particularly preferably 4 to 8% by weight.

Alkyl Sulfates

Alkyl sulfates, such as fatty alcohol sulfates for example, may also be used in the present invention. Suitable alkyl sulfates are sulfates of saturated and unsaturated $C_{6-22}$, preferably $C_{10-16}$ and more preferably $C_{11-16}$ fatty alcohols. Particularly suitable alkyl sulfates are those with a native C12-14-16 C cut and/or petrochemical C12-13, C14-15 C cut and can be comprised in the agent advantageously in quantities of 0 to 15%, preferably 0 to 10% and most preferably 0 to 8%.

Amphoteric Surfactants

The amphoteric surfactants (zwitterionic surfactants), which may be used in accordance with the invention, include betaines, alkyl amino alkylamines, alkyl-substituted amino acids, acylated amino acids and biosurfactants, of which the betaines are preferred in the context of the inventive teaching.

In a preferred embodiment, the agent according to the invention comprises one or more amphoteric surfactants in a quantity of typically 0.1 to 20% by weight, preferably 1 to 15% by weight, more preferably 2 to 12% by weight, most preferably 3 to 10% by weight and most particularly preferably 4 to 8% by weight.

Betaines

Suitable betaines are the alkyl betaines, the alkylamidobetaines, the imidazolinium betaines, the sulfo betaines (INCI Sultaines) and the phospho betaines and preferably satisfy Formula I, $$R^1—[CO—X—(CH_2)_n]_x—N^+(R^2)(R^3)—(CH_2)_m—[CH(OH)—CH_2]_y—Y^- \quad (I)$$

in which $R^1$ is a saturated or unsaturated $C_{6-22}$ alkyl group, preferably $C_{8-18}$ alkyl group, more preferably a saturated $C_{10-16}$ alkyl group, for example a saturated $C_{12-14}$ alkyl group, X is NH, $NR^4$ with the $C_{1-4}$ alkyl group $R^4$, O or S, n is a number from 1 to 10, preferably 2 to 5 and more preferably 3, x is 0 or 1, preferably 1, $R^2$, $R^3$ independently of one another represent an optionally hydroxy substituted $C_{1-4}$ alkyl group such as, for example, a hydroxyethyl group, but especially a methyl group, m is a number from 1 to 4, in particular 1, 2 or 3, y is 0 or 1 and Y is COO, $SO_3$, $OPO(OR^5)O$ or $P(O)(OR^5)O$, wherein $R^5$ is a hydrogen atom H or a $C_{1-4}$ alkyl group.

The alkyl betaines and alkylamido betaines corresponding to Formula II with a carboxylate group ($Y^-$=$COO^-$), are also known as carbo betaines.

Preferred amphoteric surfactants are the alkyl betaines corresponding to formula (Ia), the alkylamido betaines corresponding to formula (Ib), the sulfo betaines corresponding to formula (Ic) and the amido sulfo betaines corresponding to formula (Id):

$$R^1—N^+(CH_3)_2—CH_2COO^- \quad (Ia)$$

$$R^1—CO—NH—(CH_2)_3—N^+(CH_3)_2—CH_2COO^- \quad (Ib)$$

$$R^1—N^+(CH_3)_2CH_2CH(OH)CH_2SO_3^- \quad (Ic)$$

$$R^1—CO—NH—(CH_2)_3—W(CH_3)_2—CH_2CH(OH)CH_2SO_3^- \quad (Id)$$

in which $R^1$ has the same meaning as in Formula I.

Particularly preferred amphoteric surfactants are the carbo betaines and more particularly the carbo betaines corresponding to formulae (Ia) and (Ib), the alkylamido betaines corresponding to formula (Ib) being most particularly preferred.

Exemplary suitable betaines and sulfo betaines are the following compounds named according to INCI: Almondamidopropyl Betaine, Apricotamidopropyl Betaine, Avocadamidopropyl Betaine, Babassuamidopropyl Betaine, Behenamidopropyl Betaine, Behenyl Betaine, Betaine, Canolamidopropyl Betaine, Capryl/Capramidopropyl Betaine, Carnitine, Cetyl Betaine, Cocamidoethyl Betaine, Cocamidopropyl Betaine, Cocamidopropyl Hydroxysultaine, Coco-Betaine, Coco-Hydroxysultaine, Coco/Oleamidopropyl Betaine, Coco-Sultaine, Decyl Betaine, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl PG-Betaine, Erucamidopropyl Hydroxysultaine, Hydrogenated Tallow Betaine, Isostearamidopropyl Betaine, Lauramido propyl Betaine, Lauryl Betaine, Lauryl Hydroxysultaine, Lauryl Sultaine, Milkamidopropyl Betaine, Minkamidopropyl Betaine, Myristamidopropyl Betaine, Myristyl Betaine, Oleamidopropyl Betaine, Oleamidopropyl Hydroxysultaine, Oleyl Betaine, Olivamidopropyl Betaine, Palmamidopropyl Betaine, Palmitamidopropyl Betaine, Palmitoyl Carnitine, Palm Kernelamidopropyl Betaine, Polytetrafluoroethylene Acetoxypropyl Betaine, Ricinoleamidopropyl Betaine, Sesamidopropyl Betaine, Soyamidopropyl Betaine, Stearamidopropyl Betaine, Stearyl Betaine, Tallowamidopropyl Betaine, Tallowamidopropyl Hydroxysultaine, Tallow Betaine, Tallow Dihydroxyethyl Betaine, Undecylenamidopropyl Betaine and Wheat Germamidopropyl Betaine. A preferred betaine is, for example, Cocamidopropyl Betaine (Cocoamidopropylbetaine).

Alkylamido Alkylamines

The alkylamido alkylamines (INCI Alkylamido Alkylamines) are amphoteric surfactants corresponding to Formula (III), $$R^9—CO—NR^{19}—(CH_2)_i—N(R^{11})—(CH_2CH_2O)_j—(CH_2)_k[CH(OH)]_l—CH_2—Z—OM \quad (III)$$

in which $R^9$ is a saturated or unsaturated $C_{6-22}$ alkyl group, preferably $C_{8-18}$ alkyl group, more preferably a saturated $C_{10-16}$ alkyl group, for example a saturated $C_{12-14}$ alkyl group, $R^{10}$ is a hydrogen atom H or a $C_{1-4}$ alkyl group, preferably H, i is a number from 1 to 10, preferably 2 to 5, particularly 2 or 3, $R^{11}$ is a hydrogen atom H or $CH_2COOM$ (for M see below), j is a number from 1 to 4, preferably 1 or 2, particularly 1, k is a number from 0 to 4, preferably 0 or 1, l is 0 or 1, wherein k=1 if l=1, Z is CO, $SO_2$, $OPO(OR^{12})$ or $P(O)(OR^{12})$, wherein $R^{12}$ is a $C_{1-4}$ alkyl group or M (see below), and M is a hydrogen, an alkali metal, an alkaline earth metal or a protonated alkanolamine, e.g. protonated mono-, di- or triethanolamine.

Preferred representatives satisfy the Formulae IIIa to IIId, $$R^9—CO—NH—(CH_2)_2—N(R^{11})—CH_2CH_2O—CH_2—COOM \quad (IIIa)$$

$$R^9—CO—NH—(CH_2)_2—N(R^{11})—CH_2CH_2O—CH_2CH_2—COOM \quad (IIIb)$$

$$R^9—CO—NH—(CH_2)_2—N(R^{11})—CH_2CH_2O—CH_2CH(OH)CH_2—SO_3M \quad (IIIc)$$

$$R^9—CO—NH—(CH_2)_2—N(R^{11})—CH_2CH_2O—CH_2CH(OH)CH_2—OPO_3HM \quad (IIId)$$

in which $R^{11}$ and M have the same meaning as in Formula (III).

Exemplary alkylamido alkylamines are the following compounds named according to INCI: Cocoamphodipropionic Acid, Cocobetainamido Amphopropionate, DEA-Cocoamphodipropionate, Disodium Caproamphodiacetate, Disodium Caproamphodipropionate, Disodium Capryloamphodiacetate, Disodium Capryloamphodipropionate, Disodium Cocoamphocarboxyethylhydroxypropylsulfonate, Disodium Cocoamphodiacetate, Disodium Cocoamphodipropionate, Disodium Isostearoamphodiacetate, Disodium Isostearoamphodipropionate, Disodium Laureth-5 Carboxyamphodiacetate, Disodium Lauroamphodiacetate, Disodium Lauroamphodipropionate, Disodium Oleoamphodipropionate, Disodium PPG-2-Isodeceth-7 Carboxyamphodiacetate, Disodium Stearoamphodiacetate, Disodium Tallowamphodiacetate, Disodium Wheatgermamphodiacetate, Lauroamphodipropionic Acid, Quaternium-85, Sodium Caproamphoacetate, Sodium Caproamphohydroxypropylsulfonate, Sodium Caproamphopropionate, Sodium Capryloamphoacetate, Sodium Capryloamphohydroxypropylsulfonate, Sodium Capryloamphopropionate, Sodium Cocoamphoacetate, Sodium Cocoamphohydroxypropylsulfonate, Sodium Cocoamphopropionate, Sodium Cornamphopropionate, Sodium Isostearoamphoacetate, Sodium Isostearoamphopropionate, Sodium Lauroamphoacetate, Sodium Lauroamphohydroxypropylsulfonate, Sodium Lauroampho PG-Acetate Phosphate, Sodium Lauroamphopropionate, Sodium Myristoamphoacetate, Sodium Oleoamphoacetate, Sodium Oleoamphohydroxypropylsulfonate, Sodium Oleoamphopropionate, Sodium Ricinoleoamphoacetate, Sodium Stearoamphoacetate, Sodium Stearoamphohydroxypropylsulfonate, Sodium Stearoamphopropionate, Sodium Tallamphopropionate, Sodium Tallowamphoacetate, Sodium Undecylenoamphoacetate, Sodium Undecylenoamphopropionate, Sodium Wheat Germamphoacetate and Trisodium Lauroampho PG-Acetate Chloride Phosphate.

Alkyl Substituted Amino Acids

According to the invention, preferred alkyl-substituted amino acids (NCl Alkyl-Substituted Amino Acids) are monoalkyl-substituted amino acids corresponding to formula (IV), $$R^{13}—NH—CH(R^{14})—(CH_2)_u—COOM' \quad (IV)$$

in which $R^{13}$ is a saturated or unsaturated $C_{6-22}$ alkyl group, preferably $C_{8-18}$ alkyl group, more preferably a saturated $C_{10-16}$ alkyl group, for example a saturated $C_{12-14}$ alkyl group, $R^{14}$ is a hydrogen atom H or a $C_{1-4}$ alkyl group, preferably H, u is a number from 0 to 4, preferably 0 or 1, particularly 1, and M' is a hydrogen, an alkali metal, an alkaline earth metal or a protonated alkanolamine, e.g. protonated mono-, di- or triethanolamine, alkyl substituted imino acids according to Formula (V), $$R^{15}—N—[(CH_2)_v—COOM'']_2 \quad (V)$$

in which $R^{15}$ is a saturated or unsaturated $C_{6-22}$ alkyl group, preferably $C_{8-18}$ alkyl group, more preferably a saturated $C_{10-16}$ alkyl group, for example a saturated $C_{12-14}$ alkyl group, v is a number from 1 to 5, preferably 2 or 3, particularly 2, and M'' is a hydrogen, an alkali metal, an alkaline earth metal or a protonated alkanolamine, e.g. protonated mono-, di- or triethanolamine, wherein M'' in both the carboxyl groups can have the same or two different meanings, e.g. is hydrogen and sodium or can be two times sodium, and mono- or dialkyl substituted natural amino acids according to Formula (VI), $$R^{16}—N(R^{17})—CH(R^{18})—COOM''' \quad (VI)$$

in which $R^{16}$ is a saturated or unsaturated $C_{6-22}$ alkyl group, preferably $C_{8-18}$ alkyl group, more preferably a saturated $C_{10-16}$ alkyl group, for example a saturated $C_{12-14}$ alkyl group, $R^{17}$ is a hydrogen atom or a C1-4 alkyl group, optionally hydroxy or amine substituted, e.g. a methyl, ethyl, hydroxyethyl or aminopropyl group, $R^{18}$ is the substituent of one of the 20 natural α-amino acids $H_2NCH(R^{18})COOH$, and M''' is a hydrogen, an alkali metal, an alkaline earth metal or a protonated alkanolamine, e.g. protonated mono-, di- or triethanolamine.

Particularly preferred alkyl substituted amino acids are the amino propionates according to Formula (IVa), $$R^{13}—NH—CH_2CH_2COOM' \quad (IVa)$$

in which $R^{13}$ and M' have the same meaning as in Formula (IV).

Exemplary alkyl substituted amino acids are the following compounds named according to INCI: Aminopropyl Laurylgiutamine, Cocaminobutyric Acid, Cocaminopropionic Acid, DEA-Lauraminopropionate, Disodium Cocaminopropyl Iminodiacetate, Disodium Dicarboxyethyl Cocopropylenediamine, Disodium Lauriminodipropionate, Disodium Steariminodipropionate, Disodium Tallowiminodipropionate, Lauraminopropionic Acid, Lauryl Aminopropylglycine, Lauryl Diethylenediaminoglycine, Myristaminopropionic Acid, Sodium C12-15 Alkoxypropyl Iminodipropionate, Sodium Cocaminopropionate, Sodium Lauraminopropionate, Sodium Lauriminodipropionate, Sodium Lauroyl Methylaminopropionate, TEA-Lauraminopropionate and TEA-Myristaminopropionate.

Acylated Amino Acids

Acylated amino acids are amino acids, in particular the 20 natural α-amino acids, which bear the acyl group $R^{19}CO$ of a saturated or unsaturated fatty acid $R^{19}COOH$ at the amino nitrogen atom, wherein $R^{19}$ is a saturated or unsaturated $C_{9-22}$ alkyl group, preferably a $C_{8-18}$ alkyl group, in particular a saturated $C_{10-16}$ alkyl group, for example a saturated $C_{12-14}$ alkyl group. The acylated amino acids may also be used in the form of an alkali metal salt, an alkaline earth metal salt or alkanolammonium salt, for example mono-, di- or triethanolamine. Examples of acylated amino acids are the acyl derivatives known collectively by the INCI name of Amino Acids, for example Sodium Cocoyl Glutamate, Lauroyl Glutamic Acid, Capryloyl Glycine or Myristoyl Methylalanine.

Amphoteric Surfactant Combinations

One particular embodiment of the invention is characterized by the use of two or more different amphoteric surfactants, more particularly a combination of binary amphoteric surfactants.

The combination of amphoteric surfactants preferably comprises at least one betaine, more particularly at least one alkylamido betaine and most preferably cocoamido propylbetaine.

In addition, the combination of amphoteric surfactants preferably contains at least one amphoteric surfactant from the group consisting of sodium carboxyethyl cocophosphoethylimidazoline (Phosphoteric® TC-6), $C_{8/10}$ amido propyl betaine (INCI Capryl/Capramido propyl Betaine; Tego® Betaine 810), N-2-hydroxyethyl-N-carboxymethyl fatty acid amido ethylamine Na (Rewoteric® AMV) and N-capryl/capramido ethyl-N-ethyl ether propionate Na (Rewoteric® AMVSF) and the betaine 3-(3-cocoamido-propyl)-dimethylammonium-2-hydroxypropanesulfonate (INCI Sultaine; Rewoteric® AM CAS) and the alkylamidoalkylamine N—[N'(N''-2-hydroxyethyl-N''-carboxyethylaminoethyl)-acetic acid amido]-N,N-dimethyl-N-cocoammoniumbetaine (Rewoteric® QAM 50), more particularly together with cocoamido propylbetaine.

In another particular embodiment, the agent according to the invention contains one or more amphoteric surfactants in a quantity of 1 to 15 and especially 5 to 10 wt. %.

Additional Anionic Surfactants

The inventive agent can additionally comprise one or more additional anionic surfactants in quantities of typically 0.001 to 5 wt. %, advantageously 0.01 to 4 wt. %, particularly 0.1 to 3 wt. %, particularly preferably 0.2 to 2 wt. %, most preferably 0.5 to 1.5 wt. %, for example 1 wt. %.

Suitable additional anionic surfactants are, in particular, aliphatic sulfates, such as monoglyceride sulfates and ester sulfonates (sulfofatty acid esters), lignin sulfonates, fatty acid cyanamides, anionic sulfosuccinic acid surfactants, fatty acid isethionates, acylamino alkane sulfonates (fatty acid taurides), fatty acid sarcosinates, ether carboxylic acids and alkyl (ether) phosphates.

Suitable additional anionic surfactants are also anionic Gemini-surfactants with a diphenyl oxide base structure, 2 sulfonate groups and an alkyl group on one or both benzene rings according to the Formula $O_3S(C_6H_3R)O(C_6H_3R')SO_3^-$, in which R stands for an alkyl group with e.g. 6, 10, 12 or 16 carbon atoms and R' for R' or H (Dowfax® Dry Hydrotrope Powder with $C_{16}$ alkyl group(s); NCl Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate) and fluorinated anionic surfactants, in particular perfluorinated alkylsulfonates such as ammonium $C_{9/10}$ perfluoroalkylsulfonate (Fluorad® FC 120) and the potassium salt of perfluoroctanesulfonic acid (Fluorad® FC 95).

Anionic Sulfosuccinic Acid Surfactants

Particularly preferred additional anionic surfactants are the anionic sulfosuccinic acid surfactants sulfosuccinates, sulfosuccinamates and sulfosuccinamides, particularly sulfosuccinates and sulfosuccinamates, most preferably sulfosuccinates. The sulfosuccinates are salts of the mono and diesters of sulfosuccinic acid $HOOCCH(SO_3H)CH_2COOH$, whereas the sulfosuccinamates are understood to mean the salts of the monoamide of sulfosuccinic acid and the sulfosuccinamides are the salts of the diamide of sulfosuccinic acid. A detailed description of these known anionic surfactants is given by A. Domsch and B. Irrgang in Anionic Surfactants: organic chemistry (edited by H. W. Stäche; Surfactant science series; volume 56; ISBN 0-8247-9394-3; Marcel Dekker, Inc., New York 1996, pp. 501-549).

The salts are preferably alkali metal salts, ammonium salts as well as mono, di or trialkanolammonium salts, for example, mono, di or triethanolammonium salts, particularly lithium, sodium, potassium or ammonium salts, particularly preferably sodium or ammonium salts, most preferably sodium salts.

In the sulfosuccinates, one or both carboxylic groups of the sulfosuccinic acid are esterified, advantageously with one or two of the same or different linear or branched, saturated or unsaturated, acyclic or cyclic, optionally alkoxylated alcohols containing 4 to 22, advantageously 6 to 20, particularly 8 to 18, particularly preferably 10 to 16, most preferably 12 to 14 carbon atoms. Particularly preferred esters are those of linear and/or saturated and/or acyclic and/or alkoxylated alcohols, particularly linear, saturated fatty alcohols and/or linear, saturated fatty alcohols alkoxylated with ethylene oxide and/or propylene oxide, advantageously ethylene oxide, with a degree of alkoxylation of 1 to 20, advantageously 1 to 15, particularly 1 to 10, particularly preferably 1 to 6, most preferably 1 to 4. In the context of the present invention, the monoesters are preferred over the diesters. A particularly preferred sulfosuccinate is the disodium salt of the lauryl polyglycol ester of sulfosuccinic acid (lauryl-EO-sulfosuccinate, di-Na salt; INCI Disodium Laureth Sulfosuccinate), that, for example, is commercially available as Tego® Sulfosuccinat F 30 (Goldschmidt) with a sulfosuccinate content of 30 wt. %.

In the sulfosuccinates or sulfosuccinamides, one or both carboxylic groups of the sulfosuccinic acid form a carboxylic acid amide, advantageously with a primary or secondary amine that has one or two of the same or different linear or branched, saturated or unsaturated, acyclic or cyclic, optionally alkoxylated alkyl groups with 4 to 22, advantageously 6 to 20, particularly 8 to 18, particularly preferably 10 to 16, most preferably 12 to 14 carbon atoms. Linear and/or saturated and/or acyclic alkyl groups, particularly linear, saturated fatty alkyl groups, are preferred.

Further suitable sulfosuccinates and sulfosuccinamates according to INCI are for example the following that are described in more detail in the International Cosmetic Ingredient Dictionary and Handbook: Ammonium Dinonyl Sulfosuccinate, Ammonium Lauryl Sulfosuccinate, Diammonium Dimethicone Copolyol Sulfosuccinate, Diammonium Lauramido-MEA Sulfosuccinate, Diammonium Lauryl Sulfosuccinate, Diammonium Oleamido PEG-2 Sulfosuccinate, Diamyl Sodium Sulfosuccinate, Dicapryl Sodium Sulfosuccinate, Dicyclohexyl Sodium Sulfosuccinate, Diheptyl Sodium Sulfosuccinate, Dihexyl Sodium Sulfosuccinate, Diisobutyl Sodium Sulfosuccinate, Dioctyl Sodium Sulfosuccinate, Disodium Cetearyl Sulfosuccinate, Disodium Cocamido MEA-Sulfosuccinate, Disodium Cocamido MIPA-Sulfosuccinate, Disodium Cocamido PEG-3 Sulfosuccinate, Disodium Coco-Glucoside Sulfosuccinate, Disodium Cocoyl Butyl 10 Sulfosuccinate, Disodium C12-15 Pareth Sulfosuccinate, Disodium Deceth-5 Sulfosuccinate, Disodium Deceth-6 Sulfosuccinate, Disodium Dihydroxyethyl Sulfosuccinylundecylenate, Disodium Dimethicone Copolyol Sulfosuccinate, Disodium Hydrogenated Cottonseed Glyceride Sulfosuccinate, Disodium Isodecyl Sulfosuccinate, Disodium Isostearamido MEA-Sulfosuccinate, Disodium Isostearamido MIPA-Sulfosuccinate, Disodium Isostearyl Sulfosuccinate, Disodium Laneth-5 Sulfosuccinate, Disodium Lauramido MEA-Sulfosuccinate, Disodium Lauramido PEG-2 Sulfosuccinate, Disodium Lauramido PEG-5 Sulfosuccinate, Disodium Laureth-6 Sulfosuccinate, Disodium Laureth-9 Sulfosuccinate, Disodium Laureth-12 Sulfosuccinate, Disodium Lauryl Sulfosuccinate, Disodium Myristamido MEA-Sulfosuccinate, Disodium Nonoxynol-10 Sulfosuccinate, Disodium Oleamido MEA-Sulfosuccinate, Disodium Oleamido MIPA-Sulfosuccinate, Disodium Oleamido PEG-2 Sulfosuccinate, Disodium Oleth-3 Sulfosuccinate, Disodium Oleyl Sulfosuccinate, Disodium Palmitamido PEG-2 Sulfosuccinate, Disodium Palmitoleamido PEG-2 Sulfosuccinate, Disodium PEG-4 Cocamido MIPA-Sulfosuccinate, Disodium PEG-5 Laurylcitrate Sulfosuccinate, Disodium PEG-8 Palm Glycerides Sulfosuccinate, Disodium Ricinoleamido MEA-Sulfosuccinate, Disodium Sitostereth-14 Sulfosuccinate, Disodium Stearamido MEA-Sulfosuccinate, Disodium Stearyl Sulfosuccinamate, Disodium Stearyl Sulfosuccinate, Disodium Tallamido MEA-Sulfosuccinate, Disodium Tallowamido MEA-Sulfosuccinate, Disodium Tallow Sulfosuccinamate, Disodium Tridecylsulfosuccinate, Disodium Undecylenamido MEA-Sulfosuccinate, Disodium Undecylenamido PEG-2 Sulfosuccinate, Disodium Wheat Germamido MEA-Sulfosuccinate, Disodium Wheat Germamido PEG-2 Sulfosuccinate, Di-TEA-Oleamido PEG-2 Sulfosuccinate, Ditridecyl Sodium Sulfosuccinate, Sodium Bisglycol Ricinosulfosuccinate, Sodium/MEA Laureth-2 Sulfosuccinate and Tetrasodium Dicarboxyethyl Stearyl Sulfosuccinamate. A further additional suitable sulfosuccinamate is disodium $C_{16-18}$ alkoxypropylene sulfosuccinamate.

Preferred anionic sulfosuccinic acid surfactants are imidosuccinate, mono-Na sulfosuccinic acid diisobutyl ester (Monawet® MB 45), mono-Na sulfosuccinic acid dioctyl ester (Monawet® MO-84 R2W, Rewopol® SB DO 75), mono-Na sulfosuccinic acid di-tridecyl ester (Monawet® MT 70), fatty alcohol polyglycol sulfosuccinate Na—$NH_4$ salt (sulfosuccinate, S-2), di-Na sulfosuccinic acid mono-$C_{12-14}$ 3EO ester (Texapon® SB-3), sodium sulfosuccinic acid diisooctyl ester (Texin® DOS 75) and di-Na sulfosuccinic acid mono-$C_{12/18}$ ester (Texin® 128-P), more particularly the mono-Na sulfosuccinic acid dioctyl ester synergistically co-operating with the ternary surfactant combination according to the invention with regard to draining and/or drying behavior.

In a particular embodiment, the inventive agent comprises one or a plurality of sulfosuccinates, sulfosuccinamates and/or sulfosuccinamides, preferably sulfosuccinates and/or sulfosuccinamates, particularly sulfosuccinates as the anionic sulfosuccinic acid surfactants, in quantities of typically 0.001 to 5 wt. %, advantageously 0.01 to 4 wt. %, particularly 0.1 to 3 wt. %, particularly preferably 0.2 to 2 wt. %, most preferably 0.5 to 1.5 wt. %, for example 1 wt. %.

Non-ionic Surfactants

The inventive agent can additionally comprise one or more additional non-ionic surfactants in quantities of typically 0.001 to 5 wt. %, advantageously 0.01 to 4 wt. %, particularly 0.1 to 3 wt. %, particularly preferably 0.2 to 2 wt. %, most preferably 0.5 to 1.5 wt. %, for example 1 wt. %.

Non-ionic surfactants in the context of the invention are alkoxylates, such as polyglycol ethers, fatty alcohol polyglycol ethers, alkylphenol polyglycol ethers, end-capped polyglycol ethers, mixed ethers and hydroxy mixed ethers and fatty acid polyglycol esters. Block polymers of ethylene oxide and propylene oxide as well as fatty acid alkanolamides and fatty acid polyglycol ethers are also suitable. Important classes of non-ionic surfactants according to the invention are also the amine oxides and the sugar surfactants, more particularly the alkyl polyglucosides.

Fatty Alcohol Polyglycol Ethers

In the context of the invention, fatty alcohol polyglycol ethers are unbranched or branched, saturated or unsaturated $C_{10-22}$ alcohols alkoxylated with ethylene oxide (EO) and/or propylene oxide (PO) with a degree of alkoxylation of up to 30, preferably ethoxylated $C_{10-18}$ fatty alcohols with a degree of ethoxylation of less than 30, preferably with a degree of ethoxylation of 1 to 20, more preferably 1 to 12, most preferably 1 to 8 and, in one most particularly preferred embodiment, 2 to 5, for example $C_{12-14}$ fatty alcohol ethoxylates with 2, 3 or 4 EO or a mixture of the $C_{12-14}$ fatty alcohol ethoxylates with 3 and 4 EO in a ratio by weight of 1 to 1 or isotridecyl alcohol ethoxylate with 5, 8 or 12 EO.

Amine Oxides

According to the invention, suitable amine oxides include alkylamine oxides, more particularly alkyldimethylamine oxides, alkylamido amine oxides and alkoxyalkylamine oxides. Preferred amine oxides satisfy Formula II, $$R^6R^7R^8N^+—O^- \quad (II)$$

$$R^6—[CO—NH—(CH_2)_w]_Z—N^+(R^7)(R^8)—O^- \quad (II)$$

in which $R^6$ is a saturated or unsaturated $C_{6-22}$ alkyl group, preferably a $C_{8-18}$ alkyl group, in particular a saturated $C_{10-16}$ alkyl group, for example a saturated $C_{12-14}$ alkyl group, that is attached to the nitrogen atom N in the alkylamido amine oxides through a carbonylamido alkylene group —CO—NH—$(CH_2)_z$— and in the alkoxyalkylamine oxides through a oxaalkylene group —O—$(CH_2)_Z$—, wherein z is a number from 1 to 10, preferably 2 to 5, especially 3, $R^7$, $R^8$ independently of one another are an optionally hydroxy substituted $C_{1-4}$ alkyl group such as, for example, a hydroxyethyl group, especially a methyl group.

Exemplary suitable amine oxides are the following compounds named according to INCI: Almondamidopropylamine Oxide, Babassuamidopropylamine Oxide, Behenamine Oxide, Cocamidopropyl Amine Oxide, Cocamidopropylamine Oxide, Cocamine Oxide, Coco-Morpholine Oxide, Decylamine Oxide, Decyltetradecylamine Oxide, Diaminopyrimidine Oxide, Dihydroxyethyl C8-10 Alkoxypropylamine Oxide, Dihydroxyethyl C9-11 Alkoxypropylamine Oxide, Dihydroxyethyl C12-15 Alkoxypropylamine Oxide, Dihydroxyethyl Cocamine Oxide, Dihydroxyethyl Lauramine Oxide, Dihydroxyethyl Stearamine Oxide, Dihydroxyethyl Tallowamine Oxide, Hydrogenated Palm Kernel Amine Oxide, Hydrogenated Tallowamine Oxide, Hydroxyethyl Hydroxypropyl C12-15 Alkoxypropylamine Oxide, Isostearamidopropylamine Oxide, Isostearamidopropyl Morpholine Oxide, Lauramidopropylamine Oxide, Lauramine Oxide, Methyl Morpholine Oxide, Milkamidopropyl Amine Oxide, Minkamidopropylamine Oxide, Myristamidopropylamine Oxide, Myristamine Oxide, Myristyl/Cetyl Amine Oxide, Oleamidopropylamine Oxide, Oleamine Oxide, Olivamidopropylamine Oxide, Palmitamidopropylamine Oxide, Palmitamine Oxide, PEG-3 Lauramine Oxide, Potassium Dihydroxyethyl Cocamine Oxide Phosphate, Potassium Trisphosphonomethylamine Oxide, Sesamidopropylamine Oxide, Soyamidopropylamine Oxide, Stearamidopropylamine Oxide, Stearamine Oxide, Tallowamidopropylamine Oxide, Tallowamine Oxide, Undecylenamidopropylamine Oxide and Wheat Germamidopropylamine Oxide. A preferred amine oxide is for example Cocamidopropylamine Oxide (cocoamidopropylamine oxide).

Sugar Surfactants

Sugar surfactants are known surface-active compounds which include, for example, the sugar surfactant classes of alkyl glucose esters, aldobionamides, gluconamides (sugar acid amides), glycerol amides, glycerol glycolipids, polyhydroxyfatty acid amide sugar surfactants (sugar amides) and alkyl polyglycosides described, for example, in WO 97/00609 (Henkel Corporation) and the publications cited therein (pages 4 to 12) to which reference is made in this regard and of which the disclosure is hereby included in the present application. In the context of the inventive teaching, preferred sugar surfactants are the alkyl polyglycosides and the sugar amides and their derivatives, more particularly their ethers and esters. The ethers are the products of the reaction of one or more, preferably one, sugar hydroxy group with a compound containing one or more hydroxy groups, for example $C_{1-22}$ alcohols or glycols, such as ethylene and/or propylene glycol; the sugar hydroxy group may also carry polyethylene glycol and/or propylene glycol residues. The esters are the reaction products of one or more, preferably one, sugar hydroxyl group with a carboxylic acid, more particularly a $C_{6-22}$ fatty acid.

Sugar Amides

Particularly preferred sugar amides correspond to the formula R'C(O)N(R")[Z], where R' is a linear or branched, saturated or unsaturated acyl group, preferably a linear unsaturated acyl group, containing 5 to 21, preferably 5 to 17, more preferably 7 to 15 and most preferably 7 to 13 carbon atoms, R" is a linear or branched, saturated or unsaturated alkyl group, preferably a linear unsaturated alkyl group, containing 6 to 22, preferably 6 to 18, more preferably 8 to 16 and most preferably 8 to 14 carbon atoms, a $C_{1-5}$ alkyl group, more particularly a methyl, ethyl, propyl, isopropyl, n-butyl, isobutyl, tert.-butyl or n-pentyl group, or hydrogen and Z is a sugar unit, i.e. a monosaccharide unit. Particularly preferred sugar amides are the amides of glucose, the glucamides, for example lauroyl methyl glucamide.

Alkyl Polyglycosides

The alkyl polyglycosides (APGs) are particularly preferred sugar surfactants for the purposes of the present invention and preferably correspond to the general formula $R^1O(AO)_a[G]_x$, where $R^1$ is a linear or branched, saturated or unsaturated alkyl group containing 6 to 22, preferably 6 to 18 and more preferably 8 to 14 carbon atoms, [G] is a glycosidic sugar unit and x is a number of 1 to 10 and AO stands for an alkyleneoxy group, for example an ethyleneoxy or propyleneoxy group, and a stands for the mean degree of alkoxylation of 0 to 20. The group $(AO)_a$ may also contain various alkyleneoxy units, for example ethyleneoxy or propyleneoxy units, in which case a stands for the mean total degree of alkoxylation, i.e. the sum of the degree of ethoxylation and the degree of propoxylation. Unless indicated in more detail or indicated otherwise in the following, the alkyl groups $R^1$ of the APGs are linear unsaturated groups with the indicated number of carbon atoms.

APGs are non-ionic surfactants and are known materials, which can be obtained by appropriate methods of preparative organic chemistry. The index x indicates the degree of oligomerization (DP degree), i.e. distribution of mono- and oligoglycosides, and is a number from 1 to 10. Whereas x in a given compound must always be an integer and, above all, may assume a value of 1 to 6, the value x for a specific alkyl oligoglycoside is an analytically determined calculated quantity which is generally a fractional number. Alkyl glycosides having an average degree of oligomerization x of 1.1 to 3.0 are preferably used. Alkyl glycosides with a degree of oligomerization of less than 1.7 and, more particularly, between 1.2 and 1.6 are preferred from the applicational point of view. The glycosidic sugar used is preferably xylose but especially glucose.

The alkyl or alkenyl group R' may be derived from primary alcohols containing 8 to 18 and preferably 8 to 14 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis.

However, the alkyl or alkenyl group R' is preferably derived from lauryl alcohol, myristyl alcohol, cetyl alcohol, palmitoleyl alcohol, stearyl alcohol, isostearyl alcohol or oleyl alcohol. Elaidyl alcohol, petroselinyl alcohol, arachyl alcohol, gadoleyl alcohol, behenyl alcohol, erucyl alcohol and technical mixtures thereof may also be cited.

Particularly preferred APGs are not alkoxylated (a=0) and correspond to the formula $RO[G]_x$, in which R again stands for a linear or branched, saturated or unsaturated alkyl group containing 4 to 22 carbon atoms, [G] is a glycosidic sugar, preferably glucose, and x is a number of 1 to 10, preferably 1.1 to 3 and more preferably 1.2 to 1.6. Accordingly, preferred alkyl polyglycosides are, for example, $C_{8-10}$ and a $C_{12-14}$ alkyl polyglucoside with a DP degree of 1.4 or 1.5, more particularly $C_{8-10}$ alkyl-1,5-glucoside and $C_{12-14}$ alkyl-1,4-glucoside.

Cationic Surfactants

The agent according to the invention may additionally comprise one or more cationic surfactants (cationic surfactants; INCI Quaternary Ammonium Compounds) in a quantity of typically 0.001 to 5% by weight, preferably 0.01 to 4% by weight, more preferably 0.1 to 3% by weight, most preferably 0.2 to 2% by weight and, most particularly 0.5 to 1.5% by weight, for example 1% by weight.

Preferred cationic surfactants are the quaternary surface-active compounds, more particularly containing an ammonium, sulfonium, phosphonium, iodonium or arsonium group, which are described as antimicrobial agents, for example, in K. H. Walhäuser's "Praxis der Sterilisation, Desinfektion-Konservierung: Keimidentifizierung-Betriebshygiene" (5th Edition, Stuttgart/New York: Thieme, 1995). By adding quaternary surface-active compounds with antimicrobial activity, the agent can be furnished with an antimicrobial activity or its existing antimicrobial activity, resulting from the possible presence of other ingredients, can be improved.

In addition to the quaternary ammonium compounds of Formula I used as drying and sparkle additives, particularly preferred cationic surfactants are quaternary ammonium compounds (QUATS; INCI Quaternary Ammonium Compounds) corresponding to the general formula $(R^I)(R^{II})(R^{III})(R^{IV})N^+X^-$, in which $R^I$ to $R^{IV}$ may be the same or different and represent $C_{1-22}$ alkyl groups, $C_{7-28}$ aralkyl groups or heterocyclic groups, two or—in the case of an aromatic compound, such as pyridine—even three groups together with the nitrogen atom forming the heterocycle, for example a pyridinium or imidazolinium compound, and $X^-$ represents halide ions, sulfate ions, hydroxide ions or similar anions. In the interests of optimal antimicrobial activity, at least one of the substituents preferably has a chain length of 8 to 18 and, more preferably, 12 to 16 carbon atoms.

QUATS can be obtained by reacting tertiary amines with alkylating agents such as, for example, methyl chloride, benzyl chloride, dimethyl sulfate, dodecyl bromide but also ethylene oxide. The alkylation of tertiary amines having one long alkyl chain and two methyl groups is particularly easy. The quaternization of tertiary amines containing two long chains and one methyl group can also be carried out under mild conditions using methyl chloride. Amines containing three long alkyl chains or hydroxy-substituted alkyl chains lack reactivity and are preferably quaternized with dimethyl sulfate.

Suitable QUATS are, for example, Benzalkonium chloride (N-alkyl-N,N-dimethylbenzyl ammonium chloride, CAS No. 8001-54-5), Benzalkon B (m,p-dichlorobenzyl dimethyl-$C_{12}$ alkylammonium chloride, CAS No. 58390-78-6), Benzoxonium chloride (benzyldodecyl-bis-(2-hydroxyethyl) ammonium chloride), Cetrimonium bromide (N-hexadecyl-N,N-trimethyl ammonium bromide, CAS No. 57-09-0), Benzetonium chloride (N,N-di-methyl-N-[2-[2-[p-(1,1,3,3-tetramethylbutyl)-phenoxy]-ethoxy]-ethyl]-benzyl ammonium chloride, CAS No. 121-54-0), dialkyl dimethyl ammonium chlorides, such as di-n-decyldimethyl ammonium chloride (CAS No. 7173-51-5-5), didecyldimethyl ammonium bromide (CAS No. 2390-68-3), dioctyl dimethyl ammonium chloride, 1-cetylpyridinium chloride (CAS No. 123-03-5) and thiazoline iodide (CAS No. 1576448-1) and mixtures thereof. Preferred QUATS are the benzalkonium chlorides containing $C_{8-18}$ alkyl groups, more particularly $C_{12-14}$ alkylbenzyldimethylammonium chloride. A particularly preferred QUAT is cocopentaethoxy methyl ammonium methosulfate (INCI PEG-5 Cocomonium Methosulfate; Rewoquat® CPEM).

To avoid possible incompatibilities of the antimicrobial cationic surfactants with the inventively comprised anionic surfactants, cationic surfactants that are the most compatible possible with anionic surfactants and/or the least possible cationic surfactant are employed, or in a particular embodiment of the invention, antimicrobially active cationic surfactants are dispensed with altogether. Parabens, benzoic acid and/or benzoate, lactic acid and/or lactates can be added as the antimicrobially active substances. Benzoic acid and/or lactic acid are particularly preferred.

Solvent

The water content of the inventively aqueous agent is usually 20 to 99 wt. %, preferably 40 to 90 wt. %, particularly 50 to 85 wt. % and particularly preferably 55 to 80 wt. %.

The inventive agent can additionally advantageously comprise one or more water-soluble organic solvents in quantities of typically 0.1 to 30 wt. %, advantageously 1 to 20 wt. %, particularly 2 to 15 wt. %, particularly preferably 4 to 12 wt. %, most preferably 6 to 10 wt. %.

In the context of the teaching according to the invention, the solvent is used as needed in particular as a hydrotropic agent, a viscosity adjuster and/or low-temperature stabilizer. It has a solubilizing effect, particularly on surfactants and electrolytes as well as for perfumes and dyes, and thus contributes to their incorporation, prevents the formation of liquid crystalline phases and contributes to the formation of clear products. The viscosity of the agent according to the invention decreases with increasing solvent content. However, too much solvent can produce too great a fall in viscosity. Finally, the cold cloud and clear point of the agent according to the invention decreases with increasing solvent content.

Exemplary suitable solvents are saturated or unsaturated, preferably saturated, branched or unbranched $C_{1-20}$ hydrocarbons, preferably $C_{2-15}$ hydrocarbons, containing at least one hydroxyl group and optionally one or more ether functions C—O—C, i.e. the chain of carbon atoms is interrupted by oxygen atoms.

Preferred solvents are the $C_{2-6}$ alkylene glycols and poly-$C_{2-3}$ alkylene glycol ethers—optionally etherified on one side with a $C_{1-6}$ alkanol—containing on average 1 to 9 identical or different, preferably identical, alkylene glycol groups per molecule as well as the $C_{1-6}$ alcohols, preferably ethanol, n-propanol or iso-propanol, especially ethanol.

Exemplary solvents are the following compounds named according to INCI: Alcohol (Ethanol), Buteth-3, Butoxydiglycol, Butoxyethanol, Butoxyisopropanol, Butoxypropanol, n-Butyl Alcohol, t-Butyl Alcohol, Butylene Glycol, Butyloctanol, Diethylene Glycol, Dimethoxydiglycol, Dimethyl Ether, Dipropylene Glycol, Ethoxydiglycol, Ethoxyethanol, Ethyl Hexanediol, Glycol, Hexanediol, 1,2,6-Hexanetriol, Hexyl Alcohol, Hexylene Glycol, Isobutoxypropanol, Isopentyldiol, Isopropyl Alcohol (isoPropanol), 3-Methoxybutanol, Methoxydiglycol, Methoxyethanol, Methoxyisopropanol, Methoxymethylbutanol, Methoxy PEG-10, Methylal, Methyl Alcohol, Methyl Hexyl Ether, Methylpropanediol, Neopentyl Glycol, PEG-4, PEG-6, PEG-7, PEG-8, PEG-9, PEG-6 Methyl Ether, Pentylene Glycol, PPG-7, PPG-2-Buteth-3, PPG-2 Butyl Ether, PPG-3 Butyl Ether, PPG-2 Methyl Ether, PPG-3 Methyl Ether, PPG-2 Propyl Ether, Propanediol, Propyl Alcohol (n-Propanol), Propylene Glycol, Propylene Glycol Butyl Ether, Propylene Glycol Propyl Ether, Tetrahydrofurfuryl Alcohol, Trimethylhexanol.

Particularly preferred solvents are the poly-$C_{2-3}$ alkylene glycol ethers etherified on one side with a $C_{1-6}$ alkanol and containing on average 1 to 9 and preferably 2 to 3 ethylene or propylene glycol groups, for example PPG-2 Methyl Ether (dipropylene glycol monomethyl ether).

Most particularly preferred solvents are the $C_{2-3}$ alcohols ethanol, n-propanol and/or iso-propanol, especially ethanol.

Besides the solvents described above, suitable solubilizers, particularly for perfume and dyes, are, for example, alkanolamines and alkylbenzene sulfonates containing 1 to 3 carbon atoms in the alkyl group.

Additives

Besides the silyl polyalkoxylates of Formula I comprised in accordance with the invention, the agent according to the invention, in order to further improve its draining and/or drying behavior, may comprise one or more additives from the group of the surfactants, the polymers and the builders in a quantity of typically 0.001 to 5 wt. %, advantageously 0.01 to 4 wt. %, particularly 0.1 to 3 wt. %, particularly preferably 0.2 to 2 wt. %, most preferably 0.5 to 1.5 wt. %, for example 1 wt. %.

Surfactants suitable as additives are certain of the above-mentioned amphoteric surfactants, other anionic surfactants, non-ionic surfactants and cationic surfactants, which will be reiterated below. The content of surface-active additives should preferably be selected such that the total surfactant content is within the quantity ranges mentioned above.

Some of the additives mentioned in the following are accompanied (in brackets) by one or more trade names under which the particular additive is commercially available.

Amphoteric surfactants suitable as additives are, in particular, sodium carboxyethyl cocophosphoethyl imidazoline (Phosphoteric® TC-6), $C_{8/10}$ amidopropyl betaine (INCI Capryl/Capramidopropyl Betaine; Tego® Betaine 810), N-2-hydroxyethyl-N-carboxymethyl fatty acid amide ethylamine Na (Rewoteric® AMV) and N-caprylic/capric amidoethyl-N-ethyl ether propionate Na (Rewoteric® AMVSF) and the betaine 3-(3-cocoamidopropyl)-dimethylammonium-2-hydroxypropane sulfonate (INCI Sultaine; Rewoteric® AM CAS) and the alkylamido alkylamine N—[N'(N"-2-hydroxyethyl-N"-carboxyethylaminoethyl)-acetic acid amido]-N,N-dimethyl-N-cocoammonium betaine (Rewoteric® QAM 50).

Suitable additional anionic surfactants are also anionic Gemini-surfactants with a diphenyl oxide base structure, 2 sulfonate groups and an alkyl group on one or both benzene rings according to the Formula $O_3S(C_6H_3R)O(C_6H_3R')SO_3^-$, in which R stands for an alkyl group with e.g. 6, 10, 12 or 16 carbon atoms and R' for R or H (Dowfax® Dry Hydrotrope Powder with $C_{16}$ alkyl group(s); INCI Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate) and fluorinated anionic surfactants, in particular perfluorinated alkylsulfonates such as ammonium $C_{9/10}$ perfluoroalkylsulfonate (Fluorad® FC 120) and the potassium salt of perfluoroctanesulfonic acid (Fluorad® FC 95) as well as the sulfosuccinic acid surfactants imidosuccinate, mono-Na sulfosuccinic acid diisobutyl ester (Monawet® MB 45), mono-Na sulfosuccinic acid dioctyl ester (Monawet® MO-84 R2W, Rewopol® SB DO 75), mono-Na sulfosuccinic acid di-tridecyl ester (Monawet® MT 70), fatty alcohol polyglycol sulfosuccinate Na—NH4 salt (sulfosuccinate, S-2), di-Na sulfosuccinic acid mono-$C_{12-14}$ 3EO ester (Texapon® SB-3), sodium sulfosuccinic acid diisooctyl ester (Texin® DOS 75) and di-Na sulfosuccinic acid mono-$C_{12/18}$ ester (Texin® 128-P).

Non-ionic surfactants that are suitable additives are especially $C_{10}$ dimethylamine oxide (Ammonyx® DO), $C_{10/14}$ fatty alcohol+1.2 PO+6.4 EO (Dehydrol® 980), $C_{12/14}$ fatty alcohol+6 EO (Dehydrol® LS6), $C_8$— fatty alcohol+1.2 PO+9EO (Dehydrol® O10), FAEO $C_{12-18}$. 7EO (Dehydrol® LT 7), FAEO $C_{12-16}$. 5.5 EO (Dehydrol LSS 5.5), FAEO $C_{9-13}$. 5 EO, FAEO $C_{10-14}$. 1.2 PO+6.4 EO, $C_{16}/_{20}$ Guerbet alcohol+8 EO, n-butyl end-capped (Dehypon® G2084), mixture of a plurality of n-butyl end-capped non-ionic surfactants and $C_{8/10}$ APG (Dehypon® Ke 2555), $C_{8/10}$ fatty alcohol+1 PO+22 EO-(2-hydroxydecyl)ether (Dehypon® Ke 3447), $C_{12/14}$ fatty alcohol+5 EO+4 PO (Dehypon® LS 54 G), $C_{12-14}$ fatty alcohol+5 EO+3 PO, methyl end-capped (Dehypon® LS 531), $C_{12-14}$ fatty alcohol+10 EO, n-butyl end-capped (Dehypon® LS104 L), $C_{11}$ oxoalcohol+8 EO (Genapol® UD 088), $C_{13}$ oxoalcohol+8EO (Genapol® X 089), $C_{13/15}$ fatty alcohol-EO adduct, n-butyl end-capped (Plurafac® LF 221) and alkoxylated fatty alcohol (Tegotens® EC-11).

Cationic surfactants suitable as additives are, in particular, cationic surfactants that are compatible with anionic surfactants, such as quaternary ammonium compounds, for example cocopentaethoxymethylammonium methosulfate (INCI PEG-5 Cocomonium Methosulfate; Rewoquat® CPEM).

Polymers suitable as additives are, in particular, maleic acid/acrylic acid copolymer Na salt (Sokalan® CP 5), modified polyacrylic acid Na salt (Sokalan® CP 10), modified polycarboxylate Na salt (Sokalan® HP 25), polyalkylene oxide, modified heptamethyl trisiloxane (Silwet® L-77), polyalkylene oxide, modified heptamethyl trisiloxane (Silwet® L-7608), polyether siloxanes (copolymers of polymethyl siloxanes with ethylene oxide/propylene oxide segments (polyether blocks), preferably water-soluble linear polyether siloxanes with terminal polyether blocks, such as Tegopren® 5840, Tegopren® 5843, Tegopren® 5847, Tegopren® 5851, Tegopren® 5863 and Tegopren® 5878).

Builders suitable as additives are, in particular, polyaspartic acid Na salt, ethylenediamine triacetate cocoalkyl acetamide (Rewopol® CHT 12), methyl glycine diacetic acid tri-Na salt (Trilon® ES 9964) and acetophosphonic acid (Turpinal® SL).

Mixtures with surface-active or polymeric additives show synergisms in the case of Monawet® MO-84 R2W, Tegopren® 5843 and Tegopren® 5863. However, the use of the Tegopren types 5843 and 5863 is not advised where the agents according to the invention are used on hard surfaces of glass, particularly glass tableware, because these silicone surfactants can be absorbed onto glass.

In one particular embodiment of the invention, the additives mentioned are not used at all.

Viscosity

The viscosity that is favorable for the agent according to the invention (at 20° C. and at a shear rate of 30 $s^{-1}$, as measured with a Brookfield LV DV II viscosimeter, spindle 25) is in the range 10 to 5000 mPas, preferably in the range 50 to 2000 mPas, more preferably in the range 100 to 1000 mPas, most preferably in the range 150 to 700 mPas and most particularly preferably in the range 200 to 500 mPas, for example 300 to 400 mPas.

To this end, the viscosity of the agent according to the invention can be increased by thickeners, particularly where the agent has a low surfactant content, and/or reduced by solvents, particularly where the agent has a high surfactant content.

Thickeners

For thickening, the agent according to the invention may additionally comprise one or more electrolyte salts and/or one or more polymeric thickeners.

Electrolyte Salts

Electrolyte salts in the context of the present invention are salts that disassociate into their ionic constituents in the aqueous agent according to the invention.

Preferred salts are the salts, more particularly alkali metal and/or alkaline earth metal salts, of an inorganic acid, preferably an inorganic acid from the group consisting of the hydrohalic acids, nitric acid and sulfuric acid, more particularly the chlorides and sulfates.

A particularly preferred electrolyte salt is magnesium sulfate, more particularly the $MgSO_4.7H_2O$ also known as Epsom salt and occurring as the mineral Epsomite.

In the context of the inventive teaching, an electrolyte salt may also be used in the form of its corresponding acid/base pair, for example hydrochloric acid and sodium hydroxide instead of sodium chloride.

The electrolyte salt content is normally not more than 8% by weight, preferably between 0.1 and 6% by weight, more preferably between 0.2 and 4% by weight, most preferably between 0.3 and 2% by weight and most particularly preferably between 0.5 and 1% by weight, for example 0.7% by weight.

Polymeric Thickeners

Polymeric thickeners in the context of the present invention are the polycarboxylates that as polyelectrolytes act as thickeners, preferably homopolymers and copolymers of acrylic acid, particularly acrylic acid copolymers such as acrylic acid-methacrylic acid copolymers, and the polysaccharides, particularly heteropolysaccharides, as well as conventional thickening polymers.

Suitable polysaccharides and heteropolysaccharides are the polysaccharide gums, for example gum arabic, agar, alginates, carrageens and salts thereof, guar, guaran, tragacanth, gellan, ramsan, dextran or xanthan and derivatives thereof, for example propoxylated guar, and mixtures thereof. Other polysaccharide thickeners, such as starches or cellulose derivatives, may be used alternatively, but preferably in addition to a polysaccharide gum, for example starches of varying origin and starch derivatives, for example hydroxyethyl starch, starch phosphate esters and starch acetates, or carboxymethyl cellulose or its sodium salt, methyl, ethyl, hydroxyethyl, hydroxypropyl, hydroxypropyl methyl or hydroxyethyl methyl cellulose or cellulose acetate.

A particularly preferred polymeric thickener is the microbial anionic heteropolysaccharide xanthan gum which is produced by *Xanthomonas campestris* and a few other species under aerobic conditions and which has a molecular weight of 2 to $15*10^6$. This polymer is obtainable from Kelco, for example, under the name of Keltrol®, for example as the cream-colored powder Keltrol® T (transparent) or the white granules Keltrol® RD (readily dispersible).

Acrylic acid polymers suitable as polymeric thickeners are, for example, the high molecular weight homopolymers of acrylic acid crosslinked with a polyalkenyl polyether, more particularly an allyl ether of sucrose, pentaerythritol or propylene (INCI Carbomer), which are also known as carboxyvinyl polymers. Polyacrylic acids such as these are obtainable inter alia from B. F. Goodrich under the name of Carbopol®, for example Carbopol® 940 (molecular weight ca. 4 000 000), Carbopol® 941 (molecular weight ca. 1 250 000) or Carbopol® 934 (molecular weight ca. 3 000 000).

However, particularly suitable polymeric thickeners are the following acrylic acid copolymers: (i) copolymers of two or more monomers from the group of acrylic acid, methacrylic acid and their simple esters, preferably formed with $C_{1-4}$ alcohols, (INCI acrylate copolymer), which include, for example, the copolymers of methacrylic acid, butyl acrylate and methyl methacrylate (CAS 25035-69-2) or of butyl acrylate and methyl methacrylate (CAS 25852-37-3) and which are available, for example, from Rohm & Haas under the trade names Aculyn® and Acusol®, e.g. the anionic non-associative polymers Aculyn 22, Aculyn 28, Aculyn® 33 (crosslinked), Acusol® 810, and Acusol® 830 (CAS 25852-37-3); (ii) crosslinked high molecular weight acrylic acid copolymers that include, for example copolymers of $C_{10-30}$ alkyl acrylates and one or more monomers from the group of acrylic acid, methacrylic acid and their simple esters, preferably formed with $C_{1-4}$ alcohols, which are crosslinked with an allyl ether of saccharose or of pentaerythritol (INCI Acrylates/C10-30 alkyl acrylate crosspolymer) and which are available from the B.F. Goodrich Company under the trade name Carbopol®, e.g. the hydrophobized Carbopol® ETD 2623 and Carbopol® 1382 (INCI Acrylates/C10-30 Alkyl Acrylate Crosspolymer) as well as Carbopol® Aqua 30 (previously Carbopol® EX 473).

The polymeric thickener content is normally not more than 8% by weight, preferably between 0.1 and 7% by weight, more preferably between 0.5 and 6% by weight, most preferably between 1 and 5% by weight and most particularly preferably between 1.5 and 4% by weight, for example between 2 and 2.5% by weight.

However, in a preferred embodiment of the invention, the agent is free of polymeric thickeners.

Dicarboxylic Acid (Salts)

In order to stabilize the agent according to the invention, particularly where it has a high surfactant content, one or more dicarboxylic acids and/or salts thereof, more particularly a agent of Na salts of adipic acid, succinic acid and glutaric acid commercially obtainable, for example, as Sokalar® DSC, may be added, advantageously in quantities of 0.1 to 8% by weight, preferably in quantities of 0.5 to 7% by weight, more preferably in quantities of 1.3 to 6% by weight and most preferably in quantities of 2 to 4% by weight-%.

A change in the content of dicarboxylic acid (salt), more particularly in quantities above 2% by weight, can contribute to a clear solution of the ingredients. The viscosity of the mixture can also be influenced within certain limits by this component. In addition, this component influences the solubility of the mixture. This component is particularly preferably used where the surfactant content is high, more particularly above 30% by weight.

However, if their presence is not essential, the agent according to the invention is preferably free from dicarboxylic acids (salts).

Auxiliaries and Additives

In addition, one or more other typical auxiliaries and additives, particularly in manual dishwashing detergents and cleaners for hard surfaces, more particularly UV stabilizers, perfume, pearlizers (INCI Opacifying Agents; for example glycol distearate, for example Cutina® AGS of Henkel KGaA or mixtures containing it, for example the Euperlans® of Henkel KGaA), SRPs (soil repellent polymers), PEG terephthalates, dyes, bleaching agents (for example hydrogen peroxide), corrosion inhibitors, preservatives (for example the technical 2-bromo-2-nitropropane-1,3-diol also known as Bronopol (CAS 52-51-7) which is commercially obtainable as Myacide® BT or as Boots Bronopol B from Boots) and skin-feel-improving or skin-care additives (for example dermatologically active substances, such as vitamin A, vitamin B2, vitamin B12, vitamin C, vitamin E, D-panthenol, sericerin, collagen partial hydrolyzate, various vegetable protein partial hydrolyzates, protein hydrolyzate/fatty acid condensates, liposomes, polypropylene glycol, Nutrilan®, Chitosan®, cholesterol, vegetable and animal oils such as, for example, lecithin, soybean oil, etc., plant extracts such as, for example, aloe vera, azulene, hamamelis extracts, algal extracts, etc., allantoin, AHA complexes), may be present in the agents according to the invention in quantities of normally not more than 5% by weight. Minor amounts of enzymes can be added to increase the performance. Proteases (e.g. BLAP (Henkel), Savinase (NOVO), Durazym (NOVO), Maxapemm, etc.), Amylases (e.g. Fermamyl (NOVO), etc.), Lipases (e.g. Lipolase (NOVO), etc.), Peroxidases, Gluconases, Cellulases, Mannases, etc. are preferred in quantities of preferably 0.001 to 1.5% and particularly preferably less than 0.5%.

pH

The pH of the of the agents according to the invention may be adjusted with typical pH adjusters, for example acids, such as mineral acids or citric acid, and/or alkalis, such as sodium or potassium hydroxide, a pH in the range from 4 to 9, preferably in the range from 5 to 8 and more particularly in the range from 6 to 7 being preferred, above all where compatibility with the hands is required.

In order to adjust and/or stabilize the pH value, the agent according to the invention may contain one or more buffers (INCI Buffering Agents) in quantities of typically 0.001 to 5% by weight, preferably 0.005 to 3% by weight, more preferably 0.01 to 2% by weight, most preferably 0.05 to 1% by weight and most particularly preferably 0.1 to 0.5% by weight, for example 0.2% by weight. Buffers, which are also complexing agents or even chelators (INCI Chelating Agents), are preferred. Particularly preferred buffers are citric acid or the citrates, more particularly the sodium and potassium citrates, for example trisodium citrate.$2H_2O$ and tripotassium citrate.$H_2O$.

Production

The agent according to the invention may be prepared by stirring the individual constituents together in any order. The addition sequence is not crucial to the production of the agent.

Also subject matter of the present invention is a process for manufacturing one of the inventive agents described in the above embodiments, in which the individual constituents of the agent are blended together.

Water, surfactants, the silyl polyalkoxylates of Formula I according to the invention and optionally others of the ingredients mentioned above are preferably stirred together. If perfume and/or dye is/are used, they are subsequently added to the resulting solution. The pH is then adjusted as described above.

EXAMPLES

1. Production of a Six-arm Triethoxysilyl Terminated Polyalkoxylate

A polyether polyol was used as the starting material which represents a 6-arm statistical poly(ethylene oxide-co-propylene oxide) with an EO/PO ratio of 80/20 and a molecular weight of 12 000 g/mol. It was manufactured by anionic ring-opening polymerization of ethylene oxide and propylene oxide using sorbitol as the initiator. Prior to the further reaction, the polyether polyol was heated to 80° C. with stirring under a vacuum for 1 h. To a solution of polyether polyol (3 g, 0.25 mmol), triethylenediamine (9 mg, 0.081 mmol) and dibutyltin dilaurate (9 mg, 0.014 mmol) in 25 ml anhydrous toluene was added drop wise a solution of (3-isocyanatopropyl)triethoxysilane (0.6 ml, 2.30 mmol) in 10 ml anhydrous toluene. The solution was stirred overnight at 50° C. After the toluene had been removed under vacuum, the crude product was repeatedly washed with anhydrous ether. After drying under vacuum, the product was obtained as a colorless viscous liquid; it possessed a triethoxysilyl group on each free end of the polymer arms of the star-shaped prepolymer. IR (Film, $cm^{-1}$): 3349 (m, —CO—NH—), 2868 (s, —$CH_2$—, —$CH_3$), 1719 (s, —C═O), 1456 (m, —$CH_2$—, —$CH_3$), 1107 (s, —C—O—C—), 954 (m, —Si—O—). $^1$H-NMR (benzene-$d_6$, ppm): 1.13 (d, —$CH_3$ of the polymer arms), 1.21 (t, —$CH_3$ of silane end groups), 3.47 (s, —$CH_2$ of the polymer arms), 3.74 (q, —$CH_2$ of silane end groups). The molecular weight of the triethoxysilyl terminated polyalkoxylate was 13 500.

2. Production of a Three-arm Triethoxysilyl Terminated Polyalkoxylate

Voranol CP 1421 from DOW Chemicals was dried under vacuum with stirring for 1 h at 80° C. To 2.04 g (0.41 mmol)

of the dried polyether polyol were slowly added 317 mg (1.0 equivalent) (3-isocyanatopropyl)triethoxysilane. The reaction mixture was stirred at 100° C. for 2 days under inert gas until the disappearance of the characteristic IR peak of the NCO group. After drying under vacuum, the product was obtained as a colorless viscous liquid; it possessed a triethoxysilyl group on each free end of the polymer arms of the polyether polyol.

3. Production of a Mixture Comprising a Three-arm as Well as an Eight-arm Triethoxysilyl Terminated Polyalkoxylate Voranol CP 4053 from DOW Chemicals was dried under vacuum with stirring for 1 h at 80° C. To 209 g (16.9 mmol) of the dried polyether polyol were slowly added 20.9 mg (0.01%) dibutyltin dilaurate and 30.3 g (1.0 equivalent) (3-isocyanatopropyl)triethoxysilane. The reaction mixture was stirred at room temperature for 2 days under inert gas until the disappearance of the characteristic IR peak of the NCO group. The product was obtained as a colorless viscous liquid; it possessed a triethoxysilyl group on each free end of the polymer arms of the polyether polyol and was a mixture of a 3-arm and an 8-arm polyalkoxylate in a ratio of ca. 20/80.

4. Agents

The inventive agents E1-E3 as well as the comparative non-inventive agent V1 were manufactured.

| | Agent (in wt. %) | | | |
|---|---|---|---|---|
| | V1 | E1 | E2 | E3 |
| Na $C_{12-14}$ fatty alcohol + 1.3 EO sulfate | 10 | 10 | 10 | 10 |
| sec. Na $C_{13-17}$ alkane sulfonate[1)] | 16 | 16 | 16 | 16 |
| Cocoamidopropyl betaine | 5 | 5 | 5 | 5 |
| Silyl polyalkoxylate[2)] | — | 0.1 | 0.5 | 5 |
| Ethanol | 8 | 8 | 8 | 8 |
| Citric acid $H_2O$ | 0.1 | 0.1 | 0.1 | 0.1 |
| Perfume | 0.45 | 0.45 | 0.45 | 0.45 |
| Water | ad 100 | ad 100 | ad 100 | ad 100 |

[1)]Hostapur ® SAS 60 (Clariant)
[2)]Silyl polyalkoxylate according to example 1

The silyl polyalkoxylate was first manufactured in the form of a solution (agent: 5 g silyl polyalkoxylate, 2.5 g water, 2.5 g acetic acid, ethanol ad 100 g). A corresponding quantity of this solution was mixed with the other constituents of each agent E1 to E.

5. Rinsing Tests(Application with a Sponge)

Wine glasses, black glass plates and black china plates were used as the test articles. The agents being tested were deposited (1 to 2 g) on a sponge and then the test articles were cleaned with the sponge. After cleaning, the test articles were rinsed with lukewarm water. The time for the surfaces to dry was then measured, and the degree of lime scale spots or deposits was visually determined and each was evaluated in comparison with the reference value. The rinsed object cleaned with agent V1 served as the reference value. The following scale was used for the evaluation:

+++' very significantly better[1], than the reference,
++ significantly better than the reference,
+ somewhat better than the reference,
– no different from the reference,
"better" means in the case of
a) drying time: reduced drying time
b) spot formation: lower degree of spots Results:

| Agent | Drying time | Spot formation |
|---|---|---|
| E1 | + | + |
| E2 | +++ | +++ |

Comparable results were obtained when one of the silyl polyalkoxylates from the synthesis examples 2 or 3 was used instead of the silyl polyalkoxylate from synthesis example 1.

6. Rinsing Tests (Application with a Wash Liquor)

6.1 Drying Speed

To test the drying rate, the reduction in weight of glass plates wetted with cleaning agent solution as a function of time was followed for the agents. The temperature of the cleaning agent solution (wash liquor) and of the plates was 20° C., the amount of wash liquor applied per glass plate was at least 0.05 g and the cleaning agent concentration was 0.4 g per liter of wash liquor. First, flat glass plates (internal diameter 16.5 cm) of which the dry weight had been determined beforehand were finely sprayed for 10 seconds with a paper-thin layer of the wash liquor using a compressor-driven air-brush spray nozzle, the plates being held at an angle of 90° to the spray jet. The spraying time of about 10 seconds in which at least 0.05 g of wash liquor is applied to a plate was determined in preliminary tests. The plate was then placed on a balance linked to a computer and the weight of the plate was recorded by the computer every second starting from when the plate was still wetted with 0.05 g of wash liquor, i.e. from a weight 0.05 g above the weight of the dry plate, to complete dryness of the plate, i.e. until the weight of the dry plate was reached. The air humidity was determined by a hygrometer that was placed immediately adjacent to the balance and was between 35 and 46% relative air humidity. Six measurements were carried out for each wash liquor. Comparison of the average values of 6 measurements produces the following result: the drying rate of the inventive agent E3 had a higher drying rate, i.e. quicker drying or better drying behavior, than the comparison agent V1.

In another test, the rinse agents to be tested were dissolved to the in-use concentration (2 ml solution/5000 ml water, 16° dH), black plates were then immersed for ca. 60 s in the warm wash liquor (40° C.) and then quickly withdrawn there from. The drying behavior was recorded as a function of time using a digital camera/video camera. The average drying times were ca. 3 mins., the inventive formulation E3 drying significantly more quickly than the comparative agent V1.

6.2 Drainage Rate

To test the drainage rate, the reduction in weight of champagne flutes with an outlet which had been filled with cleaning agent solution (wash liquor) and then left to run dry was followed as a function of time for the agents E3 and V1.

The filling level of the champagne flutes falls quickly while the drainage of wash liquor to be tested for speed starts above the falling filling level. When the filling level has fallen to the level of the outlet and hence to zero, then solely the drainage of interest occurs. Drainage ends when finally the layer of wash liquor on the glass surface has become so thin that it no longer drains off but only reduces by drying.

To this end, a balance was installed in an airtight plastic box. Through an interface, the reduction in weight was recorded every second for 5 minutes by a computer. In order to determine drainage only, the first 12 seconds were not taken into account. The champagne flutes were filled by a pump with the wash liquor maintained at 45° C. The concentration was 0.4 g cleaning agent per liter wash liquor. The tubular outlet located in the glass bottom of the champagne flutes had a diameter of 15 mm and carried the out flowing wash liquor away over the balance. Temperature and air humidity were monitored during the measurements by means of a hygrometer. Ten measurements were carried out for each wash liquor.

The average values of 10 measurements revealed that the agent E3 according to the invention showed a higher drainage rate, i.e. faster drainage or better drainage behavior, than the comparative agent V1.

The invention claimed is:

1. An aqueous liquid agent, comprising (a) an alkyl ether sulfate;

(b) a multi-arm silyl polyalkoxylate of Formula (I)

$$(H\text{-}A)_n\text{-}Z\text{-}[A\text{-}B\text{—}Si(OR^1)_r(R^2)_{3-r}]_m \quad (I),$$

in which

Z stands for an (m+n) valent group having at least three carbon atoms,

A stands for a divalent polyoxyalkylene group, wherein the (m+n) polyoxyalkylene groups that are bonded to Z can be different from one another, and wherein one A group is bonded with Z through an oxygen atom that belongs to Z and one oxygen atom that belongs to A is bonded with B or hydrogen, B stands for a chemical bond or for a divalent organic group having 1 to 50 carbon atoms, OR' stands for a hydrolysable group, $R^1$ and $R^2$ independently stand for a linear or branched alkyl group having 1 to 6 carbon atoms, r stands for a whole number from 1 to 3, and m stands for a whole number ≧1 and n stands for 0 or a whole number ≧1, wherein m+n has a value of 3 to 100;

and (c) a compound selected from the group consisting of 0-50 wt. % of an alkyl sulfonate, 0-50 wt. % of an aryl sulfonate, 0-15 wt. % of an alkyl sulfate, and 0-20 wt. % of an amphoteric surfactant.

2. The agent of claim 1, wherein the mass average of the silyl polyalkoxylate of Formula (I) is from 500 to 50,000.

3. The agent of claim 1, wherein in Formula (I), Z stands for a trivalent to octavalent acyclic or cyclic hydrocarbon group containing 3 to 12 carbon atoms.

4. The agent of claim 1, wherein in Formula (I), m stands for a whole number from 3 to 8 and n stands for 0, 1 or 2.

5. The agent of claim 1, wherein in Formula (I), A stands for $—(CHR^3—CHR^4—O)_p$, wherein $R^3$ and $R^4$ independently stand for hydrogen, methyl or ethyl, and p stands for a whole number from 2 to 10,000.

6. The agent of claim 1, wherein in Formula (I), B stands for a bond or for $—C(O)—NH—(CH_2)_3—$.

7. The agent of claim 1, comprising a hydrolysable silicic acid derivative.

8. The agent of claim 7, wherein the hydrolysable silicic acid derivative comprises a tetraalkoxysilane.

9. The agent of claim 1, wherein the silyl polyalkoxylate of Formula (I) comprises 0.01 to 10 wt. % of the total weight of the agent.

10. The agent of claim 1, wherein the silyl polyalkoxylate of Formula (I) comprises 0.1 to 2.5 wt. % of the total weight of the agent.

11. The agent of claim 1 further comprising a component selected from the group consisting of a water-soluble organic solvent, an additive, a thickener, a dicarboxylic acid salt, and an auxiliary and adjuvant.

12. The agent of claim 1, wherein the viscosity of the agent is 10 to 5000 mPas.

13. The agent of claim 1, wherein the viscosity of the agent is 150 to 700 mPas.

14. The agent of claim 1, wherein the pH of the agent is 4 to 9.

15. The agent of claim 1, further comprising a buffer.

16. The agent of claim 15, wherein the buffer is selected from the group consisting of citric acid and citrates.

17. A method for cleaning a hard surface, the method comprising contacting the hard surface with the agent of claim 1.

18. The method of claim 17, wherein the hard surface is tableware.

19. A method for improving at least one of drying and draining behavior of a wet hard surface, the method comprising contacting the hard surface with the agent of claim 1.

20. A process for manufacturing an aqueous liquid agent, the process comprising blending together the constituents of the agent of claim 1.

* * * * *